US008425729B2

(12) United States Patent
Skoog et al.

(10) Patent No.: US 8,425,729 B2
(45) Date of Patent: Apr. 23, 2013

(54) EMBOSSED NONWOVEN FABRIC

(75) Inventors: Henry Skoog, Marietta, GA (US); Craig Farrell Thomaschefsky, Marietta, GA (US); Lawrence M. Brown, Roswell, GA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 541 days.

(21) Appl. No.: 12/337,171

(22) Filed: Dec. 17, 2008

(65) Prior Publication Data

US 2009/0123707 A1 May 14, 2009

Related U.S. Application Data

(62) Division of application No. 11/011,677, filed on Dec. 14, 2004, now abandoned.

(51) Int. Cl.

| | |
|---|---|
| ***D21H 11/00*** | (2006.01) |
| ***D21H 13/00*** | (2006.01) |
| ***D21H 15/00*** | (2006.01) |
| ***B32B 5/26*** | (2006.01) |

(52) U.S. Cl.
USPC ..... 162/361; 162/362; 442/384

(58) Field of Classification Search ..... 442/381, 442/384; 162/362, 361
See application file for complete search history.

(56) References Cited

U.S. PATENT DOCUMENTS

| | | | |
|---|---|---|---|
| 2,464,301 | A | 3/1949 | Francis, Jr. |
| 2,666,369 | A | 1/1954 | Niks |
| 3,246,365 | A | 4/1966 | Kloender |
| 3,485,706 | A | 12/1969 | Evans |
| 3,507,943 | A | 4/1970 | Such et al. |
| 3,542,634 | A | 11/1970 | Such et al. |
| 3,616,157 | A | 10/1971 | Smith |
| 3,660,555 | A | 5/1972 | Rains et al. |
| 3,681,184 | A | 8/1972 | Kalwaites |
| 3,692,618 | A | 9/1972 | Dorschner et al. |
| 3,821,068 | A | 6/1974 | Shaw |
| 3,849,241 | A | 11/1974 | Butin et al. |
| 3,855,046 | A | 12/1974 | Hansen et al. |
| 4,003,758 | A | 1/1977 | Palmer et al. |
| 4,005,169 | A | 1/1977 | Cumbers |

(Continued)

FOREIGN PATENT DOCUMENTS

| | | |
|---|---|---|
| EP | 0559969 B1 | 5/1996 |
| EP | 1132512 A1 | 9/2001 |

(Continued)

OTHER PUBLICATIONS

Lawrence, K.D. et al., "An Improved Device for the Formation of Superfine, Thermoplastic Fibers," *NRL Report 5265*, Feb. 11, 1959.

(Continued)

*Primary Examiner* — Lynda Salvatore
(74) *Attorney, Agent, or Firm* — Nancy M. Klembus; Ralph H. Dean

(57) ABSTRACT

A three-dimensional hydraulically entangled nonwoven composite structure made of nonwoven fibrous web and a fibrous material integrated in the nonwoven fibrous web by hydraulic entanglement is disclosed. The nonwoven composite structure has a greater ability to maintain an embossed pattern when wet and has the ability for the structure to recover after it has been compressed, to a greater degree than previously found. Also disclosed is a method of making an embossed hydraulically entangled nonwoven composite fabric.

19 Claims, 11 Drawing Sheets

U.S. PATENT DOCUMENTS

| | | | |
|---|---|---|---|
| 4,035,219 | A | 7/1977 | Cumbers |
| 4,088,726 | A | 5/1978 | Cumbers |
| 4,128,679 | A | 12/1978 | Pohland |
| 4,170,680 | A | 10/1979 | Cumbers |
| 4,265,954 | A | 5/1981 | Romanek |
| 4,315,965 | A | 2/1982 | Mason et al. |
| 4,340,563 | A | 7/1982 | Appel et al. |
| 4,476,078 | A | 10/1984 | Tao |
| 4,493,868 | A | 1/1985 | Meitner |
| RE31,825 | E | 2/1985 | Mason et al. |
| D287,195 | S | 12/1986 | Billgren |
| 4,652,322 | A | 3/1987 | Lim |
| 4,682,942 | A | 7/1987 | Gotchel et al. |
| 4,774,124 | A | 9/1988 | Shimalla et al. |
| 4,812,284 | A | 3/1989 | Fleissner |
| 4,818,315 | A | 4/1989 | Hellgren et al. |
| D301,088 | S | 5/1989 | Kawaguchi |
| 4,902,366 | A | 2/1990 | Bader |
| 4,919,738 | A | 4/1990 | Ball et al. |
| D311,997 | S | 11/1990 | Legare |
| D313,319 | S | 1/1991 | Legare |
| D314,672 | S | 2/1991 | Legare |
| D314,673 | S | 2/1991 | Legare |
| 5,036,758 | A | 8/1991 | Kobayashi et al. |
| 5,057,357 | A | 10/1991 | Winebarger |
| 5,072,687 | A | 12/1991 | Mitchell et al. |
| 5,252,275 | A | 10/1993 | Sultze et al. |
| D341,944 | S | 12/1993 | Peter |
| 5,269,994 | A | 12/1993 | Deffenbaugh et al. |
| 5,284,703 | A | 2/1994 | Everhart et al. |
| 5,296,289 | A | 3/1994 | Collins |
| 5,389,202 | A | 2/1995 | Everhart et al. |
| 5,573,841 | A | 11/1996 | Adam et al. |
| D382,354 | S | 8/1997 | Engberg |
| D384,210 | S | 9/1997 | Du Grosriez |
| D399,062 | S | 10/1998 | Sporing |
| 5,858,515 | A | 1/1999 | Stokes et al. |
| D410,051 | S | 5/1999 | Sassak |
| 5,913,997 | A | 6/1999 | Schulz et al. |
| 5,972,147 | A | 10/1999 | Janis |
| D416,476 | S | 11/1999 | Engberg |
| D419,782 | S | 2/2000 | Saito et al. |
| 6,039,555 | A | 3/2000 | Tsuji et al. |
| 6,041,701 | A | 3/2000 | Dit Picard et al. |
| 6,103,061 | A | 8/2000 | Anderson et al. |
| 6,270,608 | B1 | 8/2001 | Vair, Jr. et al. |
| 6,332,996 | B1 | 12/2001 | Dit Picard et al. |
| D454,433 | S | 3/2002 | Peter |
| 6,355,333 | B1 | 3/2002 | Waggoner et al. |
| 6,361,784 | B1 | 3/2002 | Brennan et al. |
| 6,395,211 | B1 | 5/2002 | Dettmer et al. |
| 6,432,272 | B1 | 8/2002 | Hollenberg et al. |
| 6,436,234 | B1 | 8/2002 | Chen et al. |
| D462,180 | S | 9/2002 | Kao et al. |
| D464,806 | S | 10/2002 | Carter |
| D464,807 | S | 10/2002 | Carter |
| 6,534,174 | B1 | 3/2003 | Ouellette et al. |
| 6,537,644 | B1 | 3/2003 | Kauschke et al. |
| 6,554,963 | B1 | 4/2003 | Botelho et al. |
| 6,610,390 | B1 | 8/2003 | Kauschke et al. |
| D483,187 | S | 12/2003 | Cheng |
| D486,308 | S | 2/2004 | Delaney et al. |
| D488,306 | S | 4/2004 | Delaney |
| D488,307 | S | 4/2004 | Delaney |
| 6,752,947 | B1 | 6/2004 | Lanigan et al. |
| 6,784,126 | B2 | 8/2004 | Everhart et al. |
| 6,808,790 | B2 | 10/2004 | Chen et al. |
| 2001/0008683 | A1 | 7/2001 | Takai et al. |
| 2003/0067091 | A1 | 4/2003 | Krumm et al. |
| 2004/0121693 | A1 | 6/2004 | Anderson et al. |

FOREIGN PATENT DOCUMENTS

| | | |
|---|---|---|
| EP | 1421925 A1 | 5/2004 |
| EP | 1524350 B1 | 4/2008 |
| GB | 1339952 | 12/1973 |
| WO | WO 01/71080 | 9/2001 |
| WO | WO 02/31245 | 4/2002 |
| WO | WO 02/48440 | 6/2002 |
| WO | WO 03/021024 | 3/2003 |
| WO | WO 04/001114 | 12/2003 |

OTHER PUBLICATIONS

Wente, V.A. et al., "Manufacture of Superfine Organic Fibers," *NRL Report 4364*, May 25, 1954.
Patent Abstracts of Japan, JP 01229871 A, Sep. 13, 1989.
Patent Abstracts of Japan, JP 03152257 A, Jun. 28, 1991.
Patent Abstracts of Japan, JP 4108152 A, Apr. 9, 1992.
Patent Abstracts of Japan, JP 04289257 A, Oct. 14, 1992.
Patent Abstracts of Japan, JP 05311560 A, Nov. 22, 1993.
Patent Abstracts of Japan, JP 09078421 A, Mar. 25, 1997.
Patent Abstracts of Japan, JP 10280258, Oct. 20, 1998.
Patent Abstracts of Japan, JP 11285403 A, Oct. 19, 1999.
Patent Abstracts of Japan, JP 11350255 A, Dec. 21, 1999.
Patent Abstracts of Japan, JP 2000167962 A, Jun. 20, 2000.
Patent Abstracts of Japan, JP 2000314065 A, Nov. 14, 2000.
Patent Abstracts of Japan, JP 2001055654 A, Feb. 27, 2001.
Patent Abstracts of Japan, JP 3202461 B2, Aug. 27, 2001.

EMBOSSED NONWOVEN FABRIC

This application is a Divisional of U.S. patent application Ser. No. 11/011,677, filed Dec. 14, 2004, now abandoned, which is incorporated by reference herein.

BACKGROUND

Cloth towels and rags are commonly used in manufacturing and commercial environments for cleaning up liquids and particulates. Such woven materials are absorbent and effective in picking up particulates within the woven fibers of the material. After such towels and rags are used they are often laundered and reused. However, such woven materials have deficiencies. First, the woven structure of the cloth material makes it porous; liquids often penetrate through the cloth and can contact the hands of the user. This can be an inconvenience to the user as their hands may become dirty with the liquid they are trying to absorb with the towel or rag. Such fluid penetration often necessitates the use of multiple layers of cloth. Liquid or substances passing through the woven material can be dangerous to the user if the substance being cleaned up is a solvent, caustic material, hazardous chemical, or another similarly dangerous substance.

Secondly, even when such cloth towels and rags are laundered they often still contain residues or remnant metal particulate that can damage the surfaces that are subsequently contacted by such a towel or rag and may possibly injure the hands of the user. Finally, such cloth towels and rags often smear liquids, oils and greases rather than absorb them.

An alternative to cloth rags and towels are wipers made of pulp fibers. Although nonwoven webs of pulp fibers are known to be absorbent, nonwoven webs made entirely of pulp fibers may be undesirable for certain applications such as, for example, heavy duty wipers because they lack strength and abrasion resistance. In the past, pulp fiber webs have been externally reinforced by application of binders. Such high levels of binders can add expense and leave streaks during use which may render a surface unsuitable for certain applications such as, for example, automobile painting. Binders may also be leached out when such externally reinforced wipers are used with certain volatile or semi-volatile solvents.

Other wipers have been made that have a high pulp content which are hydraulically entangled into a continuous filament substrate. Such wipers can be used as heavy duty wipers as they are both absorbent and strong enough for repeated use. Additionally, such wipers have the advantage over cloth rags and towels of higher absorbency and less liquid passing through to the hands of the users. Examples of such materials that can be used in heavy duty wipers can be found in U.S. Pat. Nos. 5,284,703, 5,389,202 and 6,784,126, all to Everhart et al.

The embossing pattern present on such hydroentangled pulp wipers provides an embossed surface texture that aids in cleaning up and absorbing oils and greases along with particulates. However, when such wipers become wet from the liquids that they absorb, the embossing structure becomes less defined and worn. The effectiveness of the wiper is compromised and the wiper will smear any additional oils and greases that it then comes in contact.

There is a need for a hydroentangled fibrous nonwoven composite material that is absorbent, but will maintain its embossing structure in use, after the material becomes wet.

DEFINITIONS

The term "machine direction" as used herein refers to the direction of travel of the forming surface onto which fibers are deposited during formation of a nonwoven web.

The term "cross-machine direction" as used herein refers to the direction which is perpendicular to the machine direction defined above.

The term "pulp" as used herein refers to fibers from natural sources such as woody and non-woody plants. Woody plants include, for example, deciduous and coniferous trees. Non-woody plants include, for example, cotton, flax, esparto grass, milkweed, straw, jute hemp, and bagasse.

The term "average fiber length" as used herein refers to a weighted average length of pulp fibers determined utilizing a Kajaani fiber analyzer model No. FS-100 available from Kajaani Oy Electronics, Kajaani, Finland. According to the test procedure, a pulp sample is treated with a macerating liquid to ensure that no fiber bundles or shives are present. Each pulp sample is disintegrated into hot water and diluted to an approximately 0.001% solution. Individual test samples are drawn in approximately 50 to 100 ml portions from the dilute solution when tested using the standard Kajaani fiber analysis test procedure. The weighted average fiber length may be expressed by the following equation:

$$\sum_{x_i=0}^{k} (x_i * n_i)/n$$

where k=maximum fiber length $x_i$=fiber length $n_i$=number of fibers having length $x_i$ n=total number of fibers measured.

The term "low-average fiber length pulp" as used herein refers to pulp that contains a significant amount of short fibers and non-fiber particles. Many secondary wood fiber pulps may be considered low average fiber length pulps; however, the quality of the secondary wood fiber pulp will depend on the quality of the recycled fibers and the type and amount of previous processing. Low-average fiber length pulps may have an average fiber length of less than about 1.2 mm as determined by an optical fiber analyzer such as, for example, a Kajaani fiber analyzer model No. FS-100 (Kajaani Oy Electronics, Kajaani, Finland). For example, low average fiber length pulps may have an average fiber length ranging from about 0.7 to 1.2 mm. Exemplary low average fiber length pulps include virgin hardwood pulp, and secondary fiber pulp from sources such as, for example, office waste, newsprint, and paperboard scrap.

The term "high-average fiber length pulp" as used herein refers to pulp that contains a relatively small amount of short fibers and non-fiber particles. High-average fiber length pulp is typically formed from certain non-secondary (i.e., virgin) fibers. Secondary fiber pulp which has been screened may also have a high-average fiber length. High-average fiber length pulps typically have an average fiber length of greater than about 1.5 mm as determined by an optical fiber analyzer such as, for example, a Kajaani fiber analyzer model No. FS-100 (Kajaani Oy Electronics, Kajaani, Finland). For example, a high-average fiber length pulp may have an average fiber length from about 1.5 mm to about 6 mm. Exemplary high-average fiber length pulps which are wood fiber pulps include, for example, bleached and unbleached virgin softwood fiber pulps.

As used herein the term "nonwoven fabric or web" means a web having a structure of individual fibers or threads which are interlaid, but not in an identifiable manner as in a knitted fabric. Nonwoven fabrics or webs have been formed from many processes such as for example, meltblowing processes, spunbonding processes, and bonded carded web processes. The basis weight of nonwoven fabrics is usually expressed in ounces of material per square yard (osy) or grams per square meter (g/m$^2$ or gsm) and the fiber diameters useful are usually expressed in microns. (Note that to convert from osy to gsm, multiply osy by 33.91).

As used herein the term "microfibers" means small diameter fibers having an average diameter not greater than about 75 microns, for example, having an average diameter of from about 0.5 microns to about 50 microns, or more particularly, microfibers may have an average diameter of from about 2 microns to about 25 microns. Another frequently used expression of fiber diameter is denier, which is defined as grams per 9000 meters of a fiber and may be calculated as fiber diameter in microns squared, multiplied by the density in grams/cc, multiplied by 0.00707. A lower denier indicates a finer fiber and a higher denier indicates a thicker or heavier fiber. For example, the diameter of a polypropylene fiber given as 15 microns may be converted to denier by squaring, multiplying the result by 0.89 g/cc and multiplying by 0.00707. Thus, a 15 micron polypropylene fiber has a denier of about 1.42 ($15^2\times 0.89\times 0.00707=1.415$). Outside the United States the unit of measurement is more commonly the "tex", which is defined as the grams per kilometer of fiber. Tex may be calculated as denier/9.

As used herein, the term "spunbond" and "spunbonded filaments" refers to small diameter continuous filaments which are formed by extruding a molten thermoplastic material as filaments from a plurality of fine, usually circular, capillaries of a spinnerette with the diameter of the extruded filaments then being rapidly reduced as by, for example, eductive drawing and/or other well-known spun-bonding mechanisms. The production of spunbonded nonwoven webs is illustrated in patents such as, for example, in U.S. Pat. No. 4,340,563 to Appel et al., and U.S. Pat. No. 3,692,618 to Dorschner et al. The disclosures of these patents are hereby incorporated by reference.

As used herein the term "meltblown" means fibers formed by extruding a molten thermoplastic material through a plurality of fine, usually circular die capillaries as molten threads or filaments into converging high velocity gas (e.g. air) streams which attenuate the filaments of molten thermoplastic material to reduce their diameter, which may be to microfiber diameter. Thereafter, the meltblown fibers are carried by the high velocity gas stream and are deposited on a collecting surface to form a web of randomly dispersed meltblown fibers. Such a process is disclosed, in various patents and publications, including NRL Report 4364, "Manufacture of Super-Fine Organic Fibers" by B. A. Wendt, E. L. Boone and D. D. Fluharty; NRL Report 5265, "An Improved Device For The Formation of Super-Fine Thermoplastic Fibers" by K. D. Lawrence, R. T. Lukas, J. A. Young; and U.S. Pat. No. 3,849,241, issued Nov. 19, 1974, to Butin, et al As used herein, the term "bonded carded webs" refers to webs that are made from staple fibers which are usually purchased in bales. The bales are placed in a fiberizing unit/picker which separates the fibers. Next, the fibers are sent through a combining or carding unit which further breaks apart and aligns the staple fibers in the machine direction so as to form a machine direction-oriented fibrous non-woven web. Once the web has been formed, it is then bonded by one or more of several bonding methods. One bonding method is powder bonding wherein a powdered adhesive is distributed throughout the web and then activated, usually by heating the web and adhesive with hot air. Another bonding method is pattern bonding wherein heated calendar rolls or ultrasonic bonding equipment is used to bond the fibers together, usually in a localized bond pattern through the web and or alternatively the web may be bonded across its entire surface if so desired. When using bi-component staple fibers, through-air bonding equipment is, for many applications, especially advantageous.

As used herein, the term "thermoplastic" shall refer to a polymer which is capable of being melt processed.

SUMMARY OF THE INVENTION

The present invention is directed to a three-dimensional hydraulically entangled nonwoven fibrous composite structure having at least one moldable nonwoven fibrous web and a fibrous material integrated into the nonwoven fibrous web by hydraulic entangling, such that the nonwoven composite structure has a wet compression rebound ratio greater than about 0.13. In alternative embodiments, the wet compression may be greater than about 0.13, between about 0.13 and about 3.00, between about 0.13 and about 0.60, between about 0.13 and about 0.45, and between about 0.15 and about 0.45.

The nonwoven fibrous composite structure may have about 1 to about 25 percent, by weight, of the nonwoven fibrous web and more than about 70 percent, by weight, of the fibrous material. In various embodiments, the nonwoven fibrous web is a nonwoven web of continuous spunbonded filaments and may have a basis weight of from about 7 to about 300 grams per square meter.

In various embodiments, the fibrous material is pulp fibers. Such pulp fibers may be selected from the group consisting of virgin hardwood pulp fibers, virgin softwood pulp fibers, secondary fibers, non-woody fibers, and mixtures of the same.

In other embodiments, the nonwoven fibrous composite structure may also include clays, starches, particulates, and superabsorbent particles. The nonwoven fibrous composite structure may also include up to about 4 percent of a debonding agent.

Such a nonwoven fibrous composite structure may be used to make a wiper having one or more layers and having a basis weight from about 20 gsm to about 300 gsm. Alternatively, such a nonwoven fibrous composite structure may be used as a fluid distribution component of an absorbent personal care product comprising one or more layers of such a fabric, where the fluid distribution component has a basis weight of from about 20 gsm to about 300 gsm.

The invention is also directed to a high pulp content hydraulically entangled nonwoven composite fabric that has about 1 to about 25 percent, by weight, of a continuous filament nonwoven fibrous web and more than about 70 percent, by weight, of a fibrous material of pulp fibers. The continuous filament nonwoven fibrous web has a bond density greater than about 100 pin bonds per square inch and a total bond area of less than about 30 percent. The nonwoven composite fabric has a wet compression rebound ratio greater than about 0.08. In alternative embodiments, the wet compression may be greater than about 0.13, between about 0.08 and about 3.00, between about 0.08 and about 0.60, between about 0.08 and about 0.45, and between about 0.13 and about 0.45. In one embodiment the continuous filament nonwoven fibrous web is a nonwoven web of continuous spunbonded filaments. In various embodiments the pulp fibers are selected from the group consisting of virgin hardwood pulp fibers, virgin softwood pulp fibers, secondary fibers, non-woody fibers, and mixtures of the same.

The invention is also directed to a method of making an embossed, hydraulically entangled nonwoven composite fabric, such as the nonwoven fibrous structure described above.

The fabric is made by superposing a fibrous material layer over a nonwoven fibrous web layer, hydraulically entangling the layers to form a composite material, drying the composite material, heating the composite material, and embossing the composite material in an embossing gap formed by a pair of matched embossing rolls. In various embodiments, the composite material is heated, prior to embossing, to a composite material surface temperature greater than about 140° F. In other embodiments the composite material is heated to a composite material surface temperature of greater than about 200° F. and may even be greater than about 300° F. Additionally, the matched embossing rolls may be heated.

The layers of the nonwoven composite fabric may be superposed by depositing fibers onto a nonwoven fibrous web layer made of continuous filaments, by drying forming or wet-forming. Alternatively, the fibrous layer is superposed over a nonwoven fibrous web layer of continuous spunbonded filaments.

In one embodiment materials such as clays, activated charcoals, starches, particulates, and superabsorbent particulates are added to the superposed layers prior to hydraulic entangling. In another embodiment, such materials are added to the superposed, hydraulically entangled composite material. In another alternative embodiment, such materials are added to the suspension of fibers used to form the fibrous layer on the nonwoven fibrous web layer of continuous filaments.

The method may also include finishing steps in which the composite fabric is mechanically softened, pressed, creped, and brushed. Additional processing steps may include the composite fabric being subjected to a chemical post-treatment of dyes and/or adhesives.

DETAILED DESCRIPTION

Figure 1:
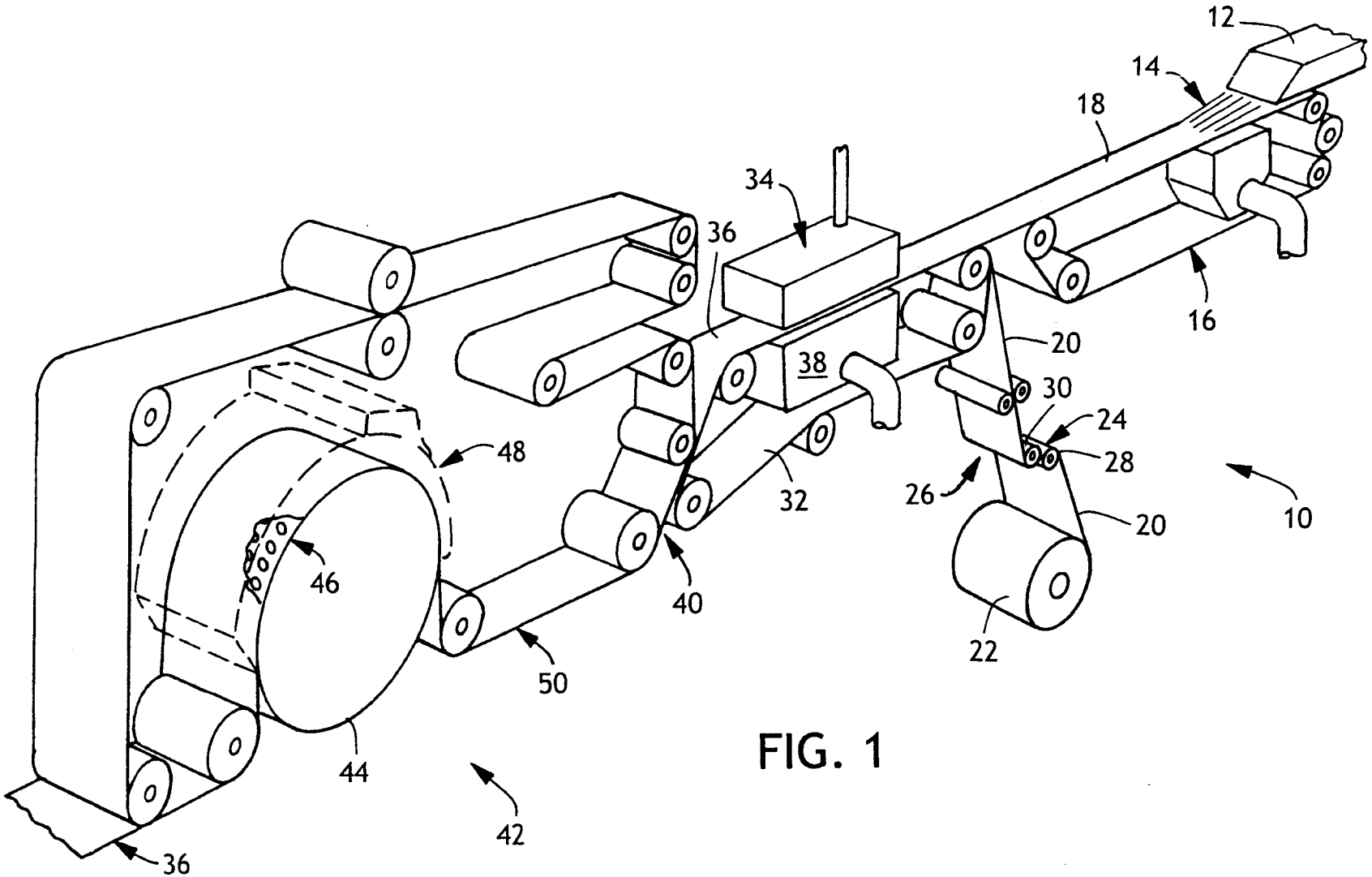
FIG. 1 is an illustration of an exemplary process for making a high pulp content nonwoven composite fabric.

Referring to FIG. 1 of the drawings there is schematically illustrated at 10 a process for forming a hydraulically entangled nonwoven composite fabric. According to the present invention, a dilute suspension of fibers is supplied by a head-box 12 and deposited via a sluice 14 in a uniform dispersion onto a forming fabric 16 of a conventional papermaking machine. The suspension of fibers may be diluted to any consistency that is typically used in conventional papermaking processes. For example, the suspension may contain from about 0.01 to about 1.5 percent by weight fibers suspended in water. Water is removed from the suspension of fibers to form the uniform layer of fibers of the fibrous material 18.

The fibers of the fibrous material 18 may be pulp fibers, natural non-woody fibers, synthetic fibers, or combinations thereof. A non-woody fiber source is any fiber species that is not a woody plant fiber source. Such non-woody fiber sources include, without limitation, seed hair fibers from milkweed and related species, abaca leaf fiber (also known as Manila hemp), pineapple leaf fibers, sabai grass, esparto grass, rice straw, banana leaf fiber, base (bark) fibers from paper mulberry, and similar fiber sources. Suitable synthetic fibers include polyolefins, rayons, acrylics, polyesters, acetates and other such staple fibers.

While it should be recognized that fibers that make up the fibrous material 18 can be chosen from a broad spectrum of fibers, as discussed above, a fibrous web of pulp fibers is used hereunder for illustrative purposes.

The pulp fibers may be any high-average fiber length pulp, low-average fiber length pulp, or mixtures of the same. The high-average fiber length pulp typically has an average fiber length from about 1.5 mm to about 6 mm. Exemplary high-average fiber length wood pulps include those available from the Kimberly-Clark Corporation under the trade designations Longlac 19, Coosa River 56, and Coosa River 57.

The low-average fiber length pulp may be, for example, certain virgin hardwood pulps and secondary (i.e. recycled) fiber pulp from sources such as, for example, newsprint, reclaimed paperboard, and office waste. The low-average fiber length pulps typically have an average fiber length of less than about 1.2 mm, for example, from 0.7 mm to 1.2 mm.

Mixtures of high-average fiber length and low-average fiber length pulps may contain a significant proportion of low-average fiber length pulps. For example, mixtures may contain more than about 50 percent by weight low-average fiber length pulp and less than about 50 percent by weight high-average fiber length pulp. One exemplary mixture contains 75 percent by weight low-average fiber length pulp and about 25 percent high-average fiber length pulp.

The pulp fibers used in the present invention may be unrefined or may be beaten to various degrees of refinement. Small amounts of wet-strength resins and/or resin binders may be added to improve strength and abrasion resistance. Useful binders and wet-strength resins include, for example, Kymene 557H available from Hercules Incorporated and Parez 631 available from American Cyanamid, Inc. Cross-linking agents and/or hydrating agents may also be added to the pulp mixture. Debonding agents may be added to the pulp mixture to reduce the degree of hydrogen bonding if a very open or loose nonwoven pulp fiber web is desired. One exemplary debonding agent is available from Hercules Incorporated, Wilmington, Del., under the trade designation ProSoft® TQ1003. The addition of certain debonding agents in the amount of, for example, 0.1 to 4 percent, by weight, of the composite also appears to reduce the measured static and dynamic coefficients of friction and improve the abrasion resistance of the continuous filament rich side of the composite fabric. The de-bonder is believed to act as a lubricant or friction reducer.

A nonwoven fibrous web 20 is unwound from a supply roll 22 and travels in the direction indicated by the arrow associated therewith as the supply roll 22 rotates in the direction of the arrows associated therewith. The nonwoven fibrous web 20 passes through a nip 24 of an S-roll arrangement 26 formed by the stack rollers 28 and 30.

The nonwoven fibrous web 20 is a nonwoven fabric or web formed by meltblowing processes, spunbonding processes, bonded carded web processes or a similar process that forms a web having a structure of individual fibers or threads which are interlaid. The nonwoven fibrous web 20 is preferably made of any type of thermoplastic polymeric fibers or polymeric fibers that are otherwise capable of being softened and molded into a desired shape. Preferably the polymeric fibers are made of polymers selected from the group including polyolefins, polyamides, polyesters, polycarbonates, polystyrenes, thermoplastic elastomers, fluoropolymers, vinyl polymers, and blends and copolymers thereof.

While it should be recognized that nonwoven fibrous web 20 may be chosen from a broad spectrum of nonwoven web production types, as discussed above, a nonwoven fibrous web 20 formed by continuous filament nonwoven extrusion processes is used hereunder for illustrative purposes.

The nonwoven fibrous web 20 may be formed by known continuous filament nonwoven extrusion processes, such as, for example, known solvent spinning or melt-spinning processes, and passed directly through the nip 24 without first being stored on a supply roll. The continuous filament nonwoven fibrous web 20 is preferably a nonwoven web of continuous melt-spun filaments formed by the spunbond process. The spunbond filaments may be formed from any melt-spinnable polymer, co-polymers or blends thereof.

For example, the spunbond filaments may be formed from polyolefins, polyamides, polyesters, polyurethanes, A-B and A-B-A' block copolymers where A and A' are thermoplastic end-blocks and B is an elastomeric mid-block, and copolymers of ethylene and at least one vinyl monomer such as, for example, vinyl acetates, unsaturated aliphatic monocarboxylic acids, and esters of such monocarboxylic acids. If the filaments are formed from a polyolefin such as, for example, polypropylene, the nonwoven fibrous web 20 may have a basis weight from about 3.5 to about 70 grams per square meter (gsm). More particularly, the nonwoven fibrous web 20 may have a basis weight from about 10 to about 35 gsm. The polymers may include additional materials such as, for example, pigments, antioxidants, flow promoters, stabilizers and the like.

One important characteristic of the continuous filament nonwoven fibrous web 20 is that it has a total bond area of less than about 30 percent and a uniform bond density greater than about 100 bonds per square inch. For example, the continuous filament nonwoven fibrous web 20 may have a total bond area from about 2 to about 30 percent (as determined by conventional optical microscopic methods) and a bond density from about 250 to about 500 pin bonds per square inch.

Figure 2:
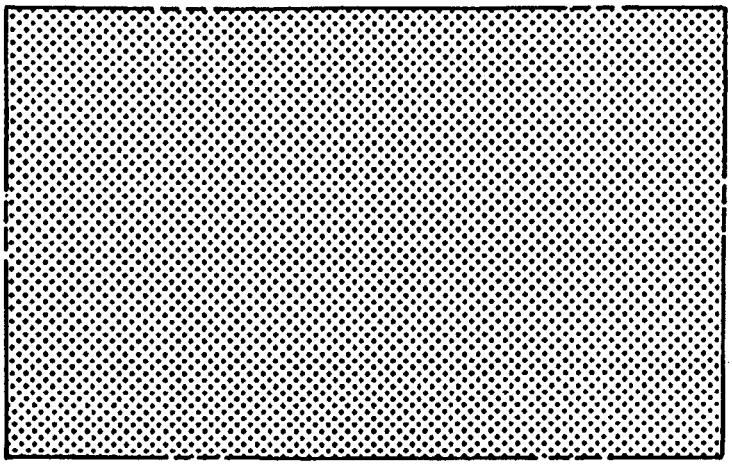
FIG. 2 is a plan view of an exemplary bond pattern.

Such a combination total bond area and bond density may be achieved by bonding the continuous filament substrate with a pin bond pattern having more than about 100 pin bonds per square inch which provides a total bond surface area less than about 30 percent when fully contacting a smooth anvil roll. Desirably, the bond pattern may have a pin bond density from about 250 to about 350 pin bonds per square inch and a total bond surface area from about 10 percent to about 25 percent when contacting a smooth anvil roll. An exemplary bond pattern is shown in FIG. 2 (714 pattern).

Figure 3:
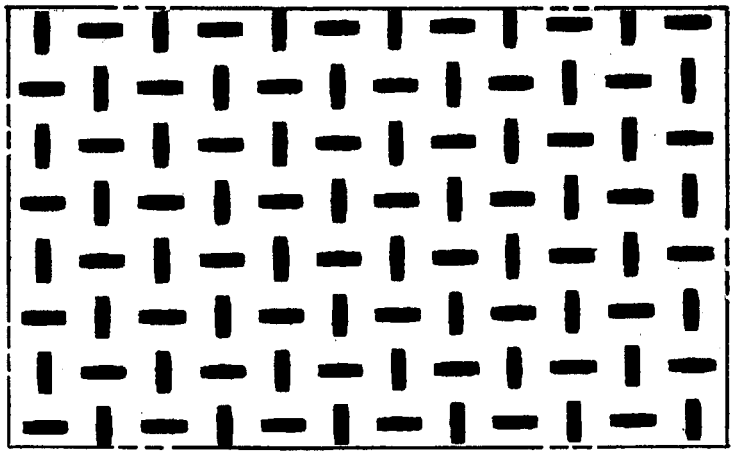
FIG. 3 is a plan view of an exemplary bond pattern.
Figure 4:
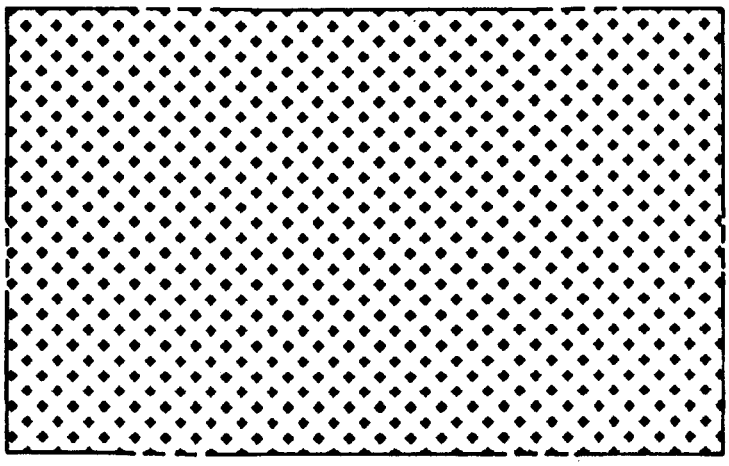
FIG. 4 is a plan view of an exemplary bond pattern.

That bond pattern has a pin density of about 272 pins per square inch. Each pin defines square bond surface having sides which are about 0.025 inch in length. When the pins contact a smooth anvil roller they create a total bond surface area of about 15.7 percent. High basis weight substrates generally have a bond area which approaches that value. Lower basis weight substrates generally have a lower bond area. FIG. 3 is another exemplary bond pattern (WW13 pattern). The pattern of FIG. 3 has a pin density of about 308 pins per square inch. Each pin defines a bond surface having 2 parallel sides about 0.035 inch long (and about 0.02 inch apart) and two opposed convex sides, each having a radius of about 0.0075 inch. When the pins contact a smooth anvil roller they create a total bond surface area of about 17.2 percent. FIG. 4 is another bond pattern that may be used. The pattern of FIG. 4 has a pin density of about 103 pins per square inch. Each pin defines a square bond surface having sides that are about 0.043 inch in length. When the pins contact a smooth anvil roller they create a total bond surface area of about 16.5 percent.

Although pin bonding produced by thermal bond rolls is described above, the present invention contemplates any form of bonding which produces good tie down of the filaments with minimum overall bond area. For example, a combination of thermal bonding and latex impregnation may be used to provide desirable filament tie down with minimum bond area. Alternatively and/or additionally, a resin, latex or adhesive may be applied to the nonwoven continuous filament web by, for example, spraying or printing, and dried to provide the desired bonding.

The fibrous material 18 is then laid on the nonwoven fibrous web 20, which rests upon a foraminous entangling surface 32 of a conventional hydraulic entangling machine. It is preferable that the fibrous material 18 is between the nonwoven fibrous web 20 and the hydraulic entangling manifolds 34. The fibrous material 18 and nonwoven fibrous web 20 pass under one or more hydraulic entangling manifolds 34 and are treated with jets of fluid to entangle the pulp fibers with the filaments of the continuous filament nonwoven fibrous web 20. The jets of fluid also drive pulp fibers into and through the nonwoven fibrous web 20 to form the composite material 36.

Alternatively, hydraulic entangling may take place while the fibrous material 18 and nonwoven fibrous web 20 are on the same foraminous screen (i.e., mesh fabric) which the wet-laying took place. The present invention also contemplates superposing a dried pulp sheet on a continuous filament nonwoven fibrous web, rehydrating the dried pulp sheet to a specified consistency and then subjecting the rehydrated pulp sheet to hydraulic entangling.

The hydraulic entangling may take place while the fibrous material 18 of pulp fibers is highly saturated with water. For example, the fibrous material 18 of pulp fibers may contain up to about 90 percent by weight water just before hydraulic entangling. Alternatively, the pulp fiber layer may be an air-laid or dry-laid layer of pulp fibers.

Hydraulic entangling a wet-laid layer of pulp fibers is desirable because the pulp fibers can be embedded into and/or entwined and tangled with the continuous filament substrate without interfering with "paper" bonding (sometimes referred to as hydrogen bonding) since the pulp fibers are maintained in a hydrated state. "Paper" bonding also appears to improve the abrasion resistance and tensile properties of the high pulp content composite fabric.

The hydraulic entangling may be accomplished utilizing conventional hydraulic entangling equipment such as may be found in, for example, in U.S. Pat. No. 3,485,706 to Evans, the disclosure of which is hereby incorporated by reference. The hydraulic entangling of the present invention may be carried out with any appropriate working fluid such as, for example, water. The working fluid flows through a manifold which evenly distributes the fluid to a series of individual holes or orifices. These holes or orifices may be from about 0.003 to about 0.015 inch in diameter. For example, the invention may be practiced utilizing a manifold produced by Rieter Perfojet S.A. of Montbonnot, France, containing a strip having 0.007 inch diameter orifices, 30 holes per inch, and 1 row of holes. Many other manifold configurations and combinations may be used. For example, a single manifold may be used or several manifolds may be arranged in succession.

In the hydraulic entangling process, the working fluid passes through the orifices at a pressures ranging from about 200 to about 2000 pounds per square inch gage (psig). At the upper ranges of the described pressures it is contemplated that the composite fabrics may be processed at speeds of about 1000 feet per minute (fpm) The fluid impacts the fibrous material 18 and the nonwoven fibrous web 20 which are supported by a foraminous surface which may be, for example, a single plane mesh having a mesh size of from about 40×40 to about 100×100. The foraminous surface may also be a multi-ply mesh having a mesh size from about 50×50 to about 200×200. As is typical in many water jet treatment processes, vacuum slots 38 may be located directly beneath the hydro-needling manifolds or beneath the foraminous entangling surface 32 downstream of the entangling manifold so that excess water is withdrawn from the hydraulically entangled composite material 36.

Although the inventors should not be held to a particular theory of operation, it is believed that the columnar jets of working fluid which directly impact fibers of the fibrous material 18 laying on the continuous filament nonwoven fibrous web 20 work to drive those fibers into and partially through the matrix or nonwoven network of filaments in the nonwoven fibrous web 20. When the fluid jets and fibers of the fibrous material 18 interact with a continuous filament nonwoven fibrous web 20 having the above-described bond characteristics (and a denier in the range of from about 5 microns to about 40 microns) the fibers are also entangled with filaments of the nonwoven fibrous web 20 and with each other. If the continuous filament nonwoven fibrous web 20 is too loosely bonded, the filaments are generally too mobile to form a coherent matrix to secure the fibers. On the other hand, if the total bond area of the nonwoven fibrous web 20 is too great, the fiber penetration may be poor. Moreover, too much bond area will also cause a splotchy composite material 36 because the jets of fluid will splatter, splash and wash off fibers when they hit the large non-porous bond spots. The specified levels of bonding provide a coherent substrate which may be formed into a composite material 36 by hydraulic entangling on only one side and still provide a strong, useful fabric as well as a composite material 36 having desirable dimensional stability.

In one aspect of the invention, the energy of the fluid jets that impact the fibrous material 18 and nonwoven fibrous web 20 may be adjusted so that the fibers of the fibrous material 18 are inserted into and entangled with the continuous filament nonwoven fibrous web 20 in a manner that enhances the two-sidedness of the composite material 36. That is, the entangling may be adjusted to produce high fiber concentration on one side of the composite material 36 and a corresponding low fiber concentration on the opposite side. Such a configuration may be particularly useful for special purpose wipers and for personal care product applications such as, for example, disposable diapers, feminine pads, adult incontinence products and the like. Alternatively, the continuous filament nonwoven fibrous web 20 may be entangled with a fibrous material on one side and a different fibrous material on the other side to create a composite material 36 with two fiber-rich sides. In that case, hydraulically entangling both sides of the composite material 36 is desirable.

After the fluid jet treatment, the composite material 36 may be transferred to a non-compressive drying operation. A differential speed pickup roll 40 may be used to transfer the material from the hydraulic needling belt to a non-compressive drying operation. Alternatively, conventional vacuum-type pickups and transfer fabrics may be used. If desired, the composite fabric may be wet-creped before being transferred to the drying operation. Non-compressive drying of the web may be accomplished utilizing a conventional rotary drum through-air drying apparatus shown in FIG. 1 at 42. The through-dryer 42 may be an outer rotatable cylinder 44 with perforations 46 in combination with an outer hood 48 for receiving hot air blown through the perforations 46. A through-dryer belt 50 carries the composite material 36 over the upper portion of the outer rotatable cylinder 44. The heated air forced through the perforations 46 in the outer rotatable cylinder 44 of the through-dryer 42 removes water from the composite fabric 36. The temperature of the air forced through the composite material 36 by the through-dryer 42 may range from about 200° to about 500° F. Other useful through-drying methods and apparatus may be found in, for example, U.S. Pat. Nos. 2,666,369 and 3,821,068, the contents of which are incorporated herein by reference.

It may be desirable to use finishing steps and/or post treatment processes to impart selected properties to the composite material 36. For example, the fabric may be lightly pressed by calendar rolls, creped or brushed to provide a uniform exterior appearance and/or certain tactile properties. Alternatively and/or additionally, chemical post-treatments such as, adhesives or dyes may be added to the fabric.

In one aspect of the invention, the fabric may contain various materials such as, for example, activated charcoal, clays, starches, and superabsorbent materials. For example, these materials may be added to the suspension of pulp fibers used to form the pulp fiber layer. These materials may also be deposited on the pulp fiber layer prior to the fluid jet treatments so that they become incorporated into the composite fabric by the action of the fluid jets. Alternatively and/or additionally, these materials may be added to the composite fabric after the fluid jet treatments. If superabsorbent materials are added to the suspension of pulp fibers or to the pulp fiber layer before water-jet treatments, it is preferred that the superabsorbents are those which can remain inactive during the wet-forming and/or water-jet treatment steps and can be activated later. Conventional superabsorbents may be added to the composite fabric after the water-jet treatments. Useful superabsorbents include, for example, a sodium polyacrylate superabsorbent available from the Hoechst Celanese Corporation under the trade name Sanwet IM-5000 P. Superabsorbents may be present at a proportion of up to about 50 grams of superabsorbent per 100 grams of pulp fibers in the pulp fiber layer. For example, the nonwoven web may contain from about 15 to about 30 grams of superabsorbent per 100 grams of pulp fibers. More particularly, the nonwoven web may contain about 25 grams of superabsorbent per 100 grams of pulp fibers.

The ratio of basis weights of the nonwoven fibrous web 20 to fibrous material 18 for the nonwoven composite fabric will affect the end characteristics of the finished nonwoven composite fabric. For example, if the fibrous material 18 is made of pulp fibers, a greater percentage of pulp fibrous material will result in a higher absorbency. Although higher pulp content in the nonwoven composite fabric provides better absorbency, it has previously been difficult to impart any lasting embossing pattern to a material with higher pulp content (e.g., materials with greater than about 70 percent, by weight, pulp content). Generally, any embossing pattern that was imparted to such a high pulp nonwoven composite fabrics would be diminished by subsequent processing steps, including winding, unwinding, slitting and packaging. The embossing pattern would become less defined with each processing step and would essentially disappear when such a material was wetted in use.

Generally, it is desired that the nonwoven composite fabric have about 1 to 30 percent, by weight, of the nonwoven fibrous web component and more than about 70 percent, by weight, of the fibrous component. In some embodiments, it is desired that nonwoven composite fabric have about 10 to 25 percent, by weight, of the nonwoven fibrous web component and more than about 70 percent, by weight, of the fibrous component. The embossing process of the present invention, as discussed below, overcomes the deficiencies of embossing a nonwoven composite fabric with these desired fibrous component weight percentages.

Figure 5:
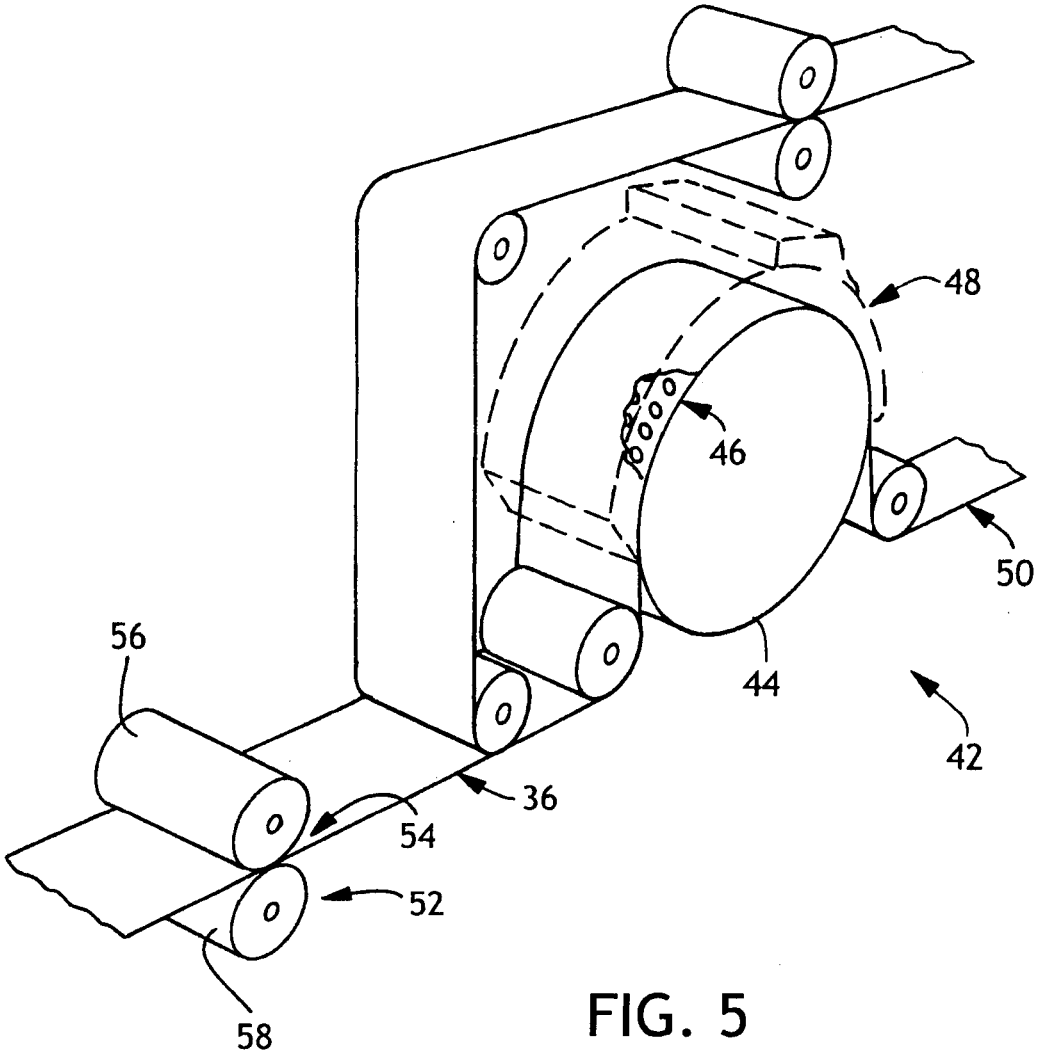
FIG. 5 is an illustration of an exemplary drying and embossing section of a process for making the embossed fabric of the present invention.

The composite material 36 is embossed after it has been dried. The embossing step may be performed in-line with, and proximate to, the drying process as shown in FIG. 5. FIG. 5 shows the drying operation of the through-air drying apparatus 42 (as seen in FIG. 1) and continuing through the embossing apparatus 52. Alternatively, the composite material 36 may be wound up after the drying operation and the wound roll 72 of composite material 36 can later may be unwound and embossed in a separate unit operation, as shown in FIG. 6.

Figure 6:
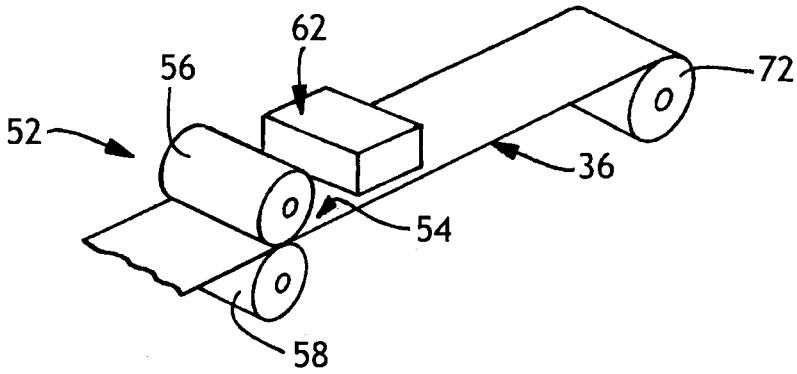
FIG. 6 is an illustration of an exemplary drying and embossing section of a process for making the embossed fabric of the present invention.

As seen in FIGS. 5 and 6, the composite material 36 is embossed by a matched pair of embossing rolls, namely a male roll 56 and a female roll 58. The male roll 56 is a patterned roll with a plurality of pins that extend out from its periphery. An exemplary embossing pin pattern can be seen in FIG. 7. Other embossing patterns and combinations of embossing patterns can be used. For example, indicia, logos, and other printed matter can be used to emboss the composite material 36. Thus the embossing pattern may include wording such as "Kimberly-Clark" or "WypAll® Wipers."

The female roll 58 has a plurality of pockets that extend into the roll from its periphery. The embossing rolls are located in proximity to one another, forming an embossing gap 54 between the matched embossing rolls through which the composite material 36 passes. The pin pattern of the male roll 56 and the pockets pattern of the female roll 58 are matched such that when they are rotated in relation to each other, the pins of the male roll 56 extend into the pockets of the female roll 58 in the embossing gap 54.

Alternatively, each roll of the matched pair of embossing rolls may have a pattern having a plurality of pins and a plurality of pockets. In this case, the male roll 56 would have a plurality of pin and a plurality of pockets dispersed among the pins. The female roll 58 would have a complementary pattern to that of the male roll 56, i.e., a plurality of pockets and a plurality of pins dispersed among the pockets. The patterns of the male and female rolls 56, 58 would be such that when brought into close proximity in the embossing gap 54, the pins of the male roll 56 would intermesh with the pockets of the female roll 58 and the pins of the female roll 58 would simultaneously intermesh with the pockets of the male roll 56.

While FIGS. 5 and 6 illustrate the male roll 56 over the female roll 58, it is also possible that their relative positions may be switched (i.e., the female roll 58 could be on top).

Figure 8:
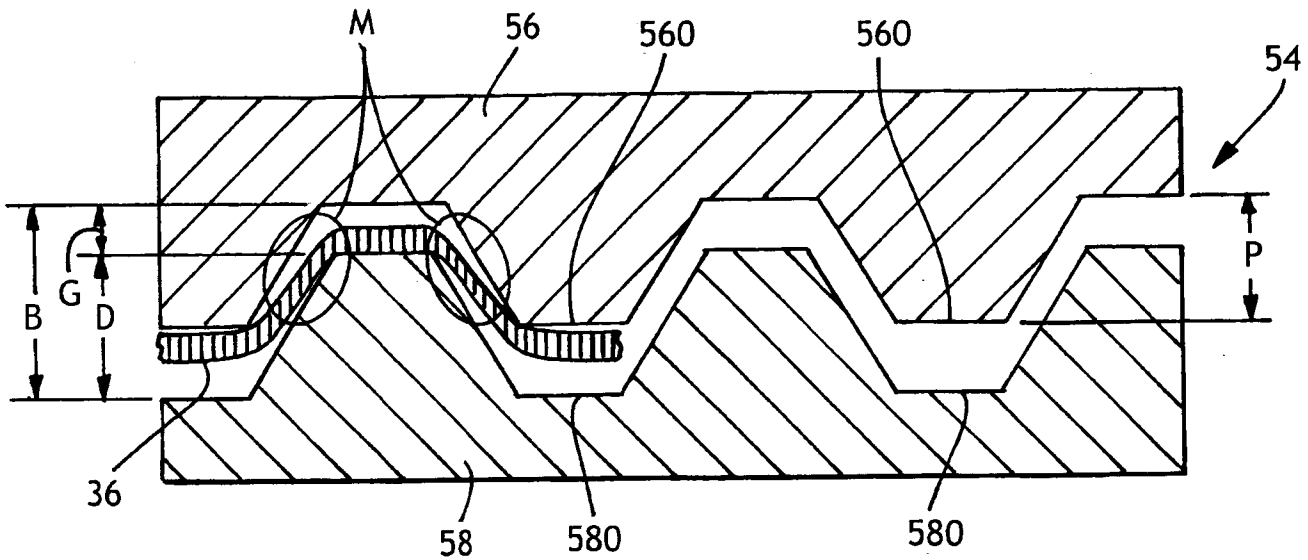
FIG. 8 is a detailed partial, cross-sectional view of an engaged pair of embossing rolls.

FIG. 8 is an enlarged partial cross sectional view of an engaged embossing gap 54, for example, for the embodiment of FIGS. 5 and 6 showing a portion of the width of the composite material 36, where the composite material 36 is traveling out of the plane of the page toward the viewer. While, for purposes of more clearly illustrating the embossing gap, the portion of the width of the composite material 36 is only shown partially across the embossing gap 54, it will be apparent that the composite material 36 may and will normally extend completely across the embossing gap 54. As shown, the pockets 580 of female roll 58 intermesh with, or accommodate, the pins 560 of the male roll 56. The intermeshing, in this case, maintains a gap, G, between the male roll 56 and the female roll 58. This gap ensures that the composite material 36 will be embossed rather than compression bonded in the embossing gap 54. If the gap, G, is too small the resulting material can be stiffer and harder than desired. For example, it is desired that the gap, G, has a height that is greater than 30 percent of the bulk of the composite material 36 entering the embossing gap 54. It may be desired that the gap, G, have a height that is greater than 50 percent of the bulk of the composite material 36 entering the embossing gap 54. It may be desired that the gap, G, have a height that is greater than 70 percent of the bulk of the composite material 36 entering the embossing gap 54.

However, the gap, G, must be small enough such that the pins can extend into the corresponding pockets to emboss the material. As shown in FIG. 8, the pins have a height, P, and the pockets have a depth, D. The height of the pin in relation to the depth of the pocket and the gap between the embossing rolls will in part determine how the composite material 36, in the discrete area of the pin, will be pushed out of the X-Y plane of the composite material web in the Z-direction. The material is essentially stretched in the Z-direction by the interaction of the pins and pockets. Thus the material takes on, or is "molded", into the pattern of matched embossing rolls 56, 58. Although the inventors should not be held to a particular theory of operation, it is believed that the material is stretched/pulled around the shoulder portions of the pins and pockets (area marked as M on FIG. 8) within the embossing gap 54.

The pin height, P, may be the same as the pocket depth, D, or the two may be different. For example, the inventors have used the pin pattern shown in FIG. 7 with a corresponding pocket pattern where the pins are nominally 0.072 inches in height and the pockets are a nominal 0.072 inches deep. The inventors have also used the same pattern where the pin height was reduced to 0.060 inches in height and the pockets remained 0.072 inches in depth.

The resulting bulk of the resulting embossed composite material 66 will be related to the gap, G, the pin height, P, the pocket depth, D, and the bulk of the composite material 36 entering the embossing gap 54. Ideally, the bulk of the resulting embossed composite material will be the distance between the base of the pins and the bottom of the pockets, shown on FIG. 8 as the distance marked as B.

The embossing of the present invention is enhanced by ensuring the composite material 36 entering the embossing gap 54 is at an elevated temperature. Preheating the composite material 36 prior to entering the embossing gap 54 increases the effectiveness of the pins and pocket stretching of the composite material 36. By heating the composite material 36, the modulus of the composite material 36 can be reduced and thus increase the ease of embossing.

The composite material can be heated sufficiently by the drying step which immediately precedes the embossing if the composite material is elevated to a sufficiently high temperature and the embossing rolls are located closed to the end of the drying operation as shown in FIG. 5. Alternatively, as shown in FIG. 6, an additional heat source 62 can be added to the process after the drying operation and prior to the matched embossing rolls 56, 58. Such an additional heat source 62 may be steam-heated can dryers, Yankee dryers, hot air hoods, a hot air knife, a heat tunnel, through air oven, infrared heater, microwave energy source or any other similar device as known in the art for heating material webs. Generally, it is desired that the material will be heated to a material surface temperature of about 140° F. or greater, just prior to entering the embossing gap 54. It may be desired to heat the material to a material surface temperature greater than 200° F. Temperatures greater than 300° F. may be desired.

Although the inventors should not be held to a particular theory of operation, it is believed that the temperature of the material needs to be high enough such the thermoplastic polymer that makes up the nonwoven fibrous web 20 portion of the composite material 36 can be softened such that the composite material can be molded in the embossing gap 54 of the matched embossing rolls 56, 58. It is believed that the modulus of the nonwoven fibrous web 20 polymer(s) is reduced such that the pins and pockets of the pattern on the matched embossing rolls can easily mold the composite material 36 into the three-dimension pattern defined by the pattern of the matched embossing rolls.

The required temperature sufficient to adequately mold composite material 36 will depend factors all related to timely heat transfer to the thermoplastic polymer of the nonwoven fibrous web 20. First, the properties of the thermoplastic polymer will determine, in part, how much heat is required. A polymer with a higher softening point will require a higher temperature to soften the polymer. A higher characteristic heat capacity for the polymer will require a higher temperature, a longer exposure to elevated temperature, or both. Secondly, the properties of the composite material, as a whole, will affect the heat required. A higher basis weight of a fibrous material 18 with a high heat capacity may require a higher temperature to soften the polymer of the nonwoven fibrous web 20, in which such fibrous material 18 is hydraulically entangled. Finally, the time in which the composite material 36 is heated and enters the embossing gap 54 will also be a factor. For example, higher line speeds may require higher temperatures in order to raise the temperature of the composite material 36 sufficiently before it reaches the embossing gap 54.

While the temperature of the nonwoven fibrous web 20 is believed to be the temperature of most interest in successfully imparting a lasting embossing pattern to the composite material 36, it is not practically possible to take such a component temperature prior to the embossing gap 54, during production. However, the surface temperature of the composite material 36 can be measured just prior to the embossing gap 54. For example, such a surface temperature can be taken with an infrared radiometer gun.

Based on the above discussion, one skilled in the art would be able to take these various heat transfer and material properties into consideration to provide the lasting embossed pattern of the present invention to a particular composite material 36, for particular process parameters.

The matched embossing rolls 56, 58 of the process, as illustrated in FIGS. 5, 6 and 8, may be constructed of steel or other materials satisfactory for the intended use conditions as will be apparent to those skilled in the art. Also, it is not necessary that the same material be used for both embossing rolls. Additionally, the embossing rolls may be heated electrically or the rolls may have double shell construction to allow a heating fluid such as oil or a mixture of ethylene glycol and water to be pumped through the roll and provide a heated surface.

Heating the embossing rolls 56, 58 aids in maintaining the temperature of the composite material web 36 as it enters the embossing gap 54. Keeping the embossing rolls close to the temperature of the composite material web 36 entering the embossing gap 54 eliminates the possible detrimental effects of large temperature differences between the composite material web 36 and the embossing rolls 56, 58. If there is a large temperature difference between the nonwoven web and a cooler embossing roll, the composite material web 36 may cool enough such that the embossing with be less effective.

Generally, when material is run through a pair of unheated embossing rolls, the rolls will tend to heat up with continuous use as a result of frictional forces. However, when the process is interrupted, the rolls will start to cool down. Such temperature differences may result in the quality of the embossing to fluctuate around such process interruptions. By heating the embossing rolls, the embossing rolls and nonwoven can be kept closer to a constant temperature and thus avoid possible quality fluctuations around process interruptions.

For the composite material surface temperature desired, as discussed above, it is desired that the matched embossed rolls be heated to a temperature of about 140° F. to about 250° F. Higher matched embossed roll temperatures may be desired to closer match higher composite material surface temperatures, if so used. These higher temperatures may include temperatures greater than about 250° F. and may be greater than about 300° F.

Embossed hydraulically entangled nonwoven composite fabrics made according to this method provide a material that has a well-defined pattern of high pattern clarity that is more resilient than similarly made materials made previously. Previously, materials that were made in a similar manner (e.g., the material discussed in U.S. Pat. No. 5,284,703 to Everhart et al.) were embossed in an offline, post-treatment step where non-heated material was embossed with an unheated, matched pair of embossing rolls. Such materials would present a fairly well-defined pattern that was clearly visible to the user. However, such a pattern would quickly disappear when the material was wetted.

The clarity of the pattern is a qualitative evaluation of how well-defined the pattern is to an observer. The clarity is evaluated on a scale of zero to ten. A clarity rating of zero indicates that there is no discernable pattern and no indication that a pattern was ever present. A clarity rating of ten is a well-defined pattern with crisp edges, defined height and depth to the pattern, and appears to be a perfect impression copy of the embossing pattern used. The qualitative clarity pattern rating of a dry sample that has not been exposed to liquid is often referred to as the "dry clarity" of the material. The qualitative pattern clarity rating of a sample that has been saturated with water is often referred to as the "wet clarity" of the material. As discussed above, the wet clarity rating of a material is generally lower than the dry clarity rating for the same material.

Figure 7:
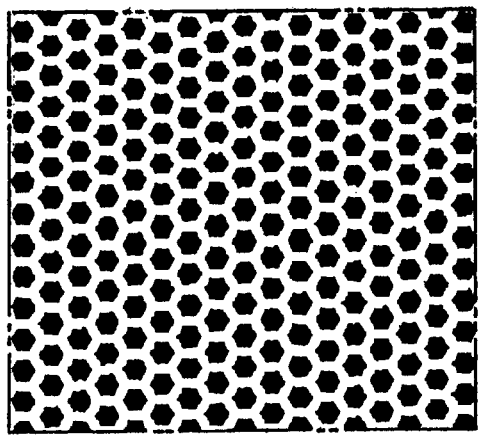
FIG. 7 is a plan view of an exemplary embossing pattern.
Figure 10:
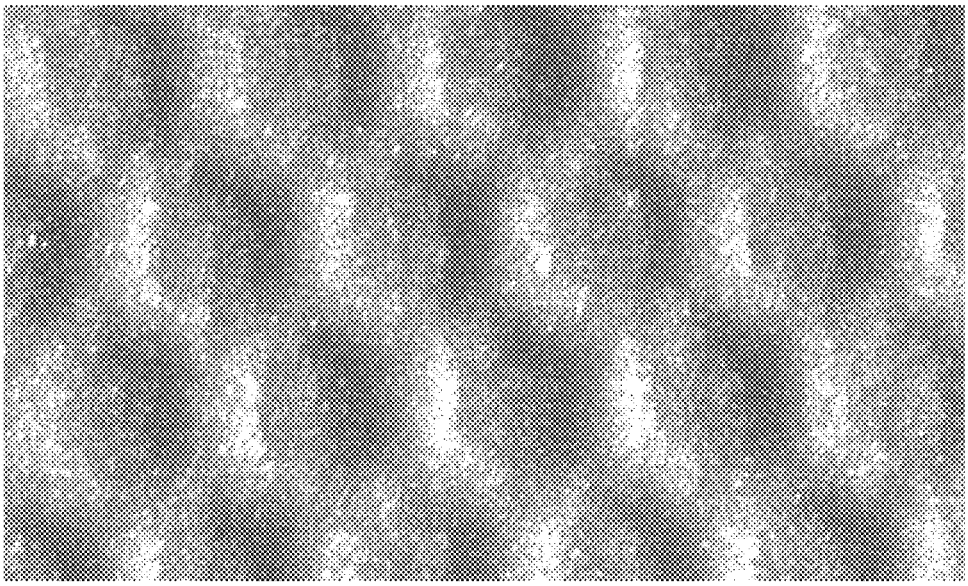
FIG. 10 is a magnified photographic view of the embossed surface of an embossed nonwoven material for comparative illustration of pattern clarity.
Figure 11:
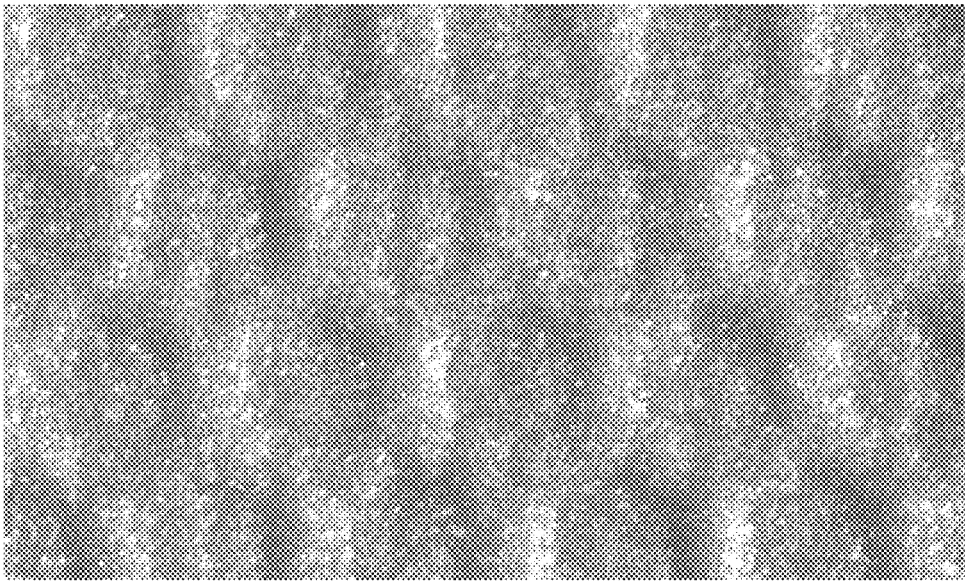
FIG. 11 is a magnified photographic view of the embossed surface of an embossed nonwoven material for comparative illustration of pattern clarity.
Figure 12:
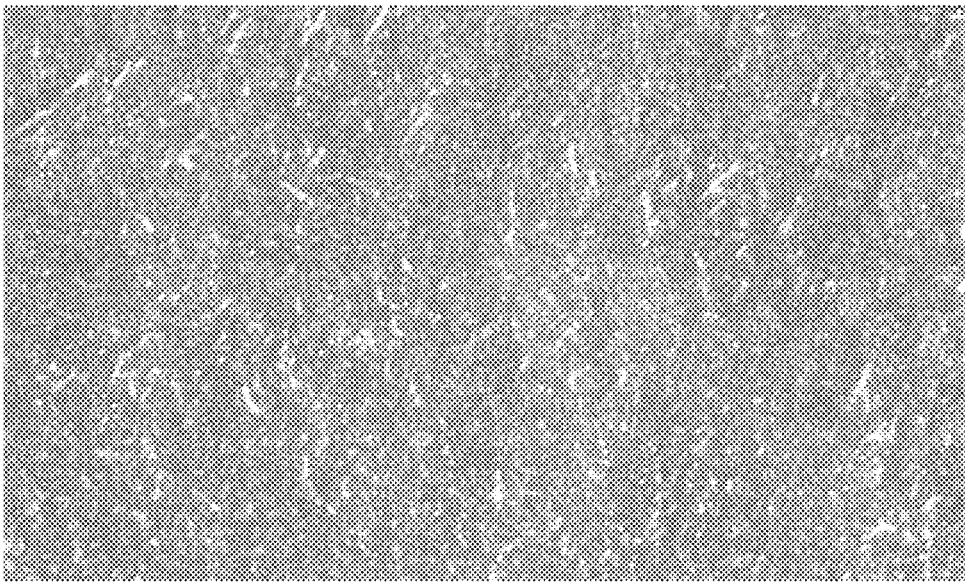
FIG. 12 is a magnified photographic view of the embossed surface of an embossed nonwoven material for comparative illustration of pattern clarity.

For comparative purposes, examples of various degrees of pattern clarity are shown in FIGS. 10, 11 and 12. The magnified photos of FIGS. 10, 11, and 12 are all at a 2.5× magnification of a commercially available wiper material that has been embossed with an embossing pattern as shown in FIG. 7, under various conditions as discussed above. The commercial material used was WYPALL® X-80 Towels, available from Kimberly-Clark Corporation, Roswell, Ga. Each of the material samples were placed in a tub of water for 10 seconds before being removed from the tub. The wet sample was placed on top of two pieces of blotter paper and two additional pieces of blotter paper are placed on top of the wet sample to remove any excess water. The samples were then qualitative rated for their wet pattern clarity (i.e., "wet clarity").

FIG. 10 represents a qualitative pattern clarity rating of eight; the pattern is well-defined and clearly visible at arm's length. FIG. 11 represents a qualitative pattern clarity rating of three; the pattern is visible and recognizable, but it is not well-defined and the edges of the pattern are unclear. FIG. 12 represents a qualitative pattern clarity rating of zero; there is no visible pattern and no evidence that the material has been embossed.

Prior to the inventive method discussed above, when material made by the previously used process had a qualitative pattern clarity rating of five when the material was dry; the pattern was identifiable when dry, but had about half of the clarity of pattern as visible on the actually embossing roll (i.e., shapes and depth is visible, but the edges of the pattern are not well defined). However, when such a material was wetted, the pattern clarity was qualitatively rated as a zero; there was no visible evidence that the material was ever embossed. As previously discussed, a wiper having such a pattern would be ineffective in cleaning a surface once it became wet because it would no longer have the necessary texture.

By using the inventive method described above, the inventors were able to produce hydraulically entangled nonwoven composite materials that had a visible, well-defined pattern after the material had been wetted. The inventors have been able to produce composite materials that have been qualitatively rated with a clarity rating of eight to ten, when they are dry. The inventive materials have also been found to have a qualitative pattern clarity rating of five to eight when they are wet. By having the patterned texture available in a wiper, even when wet, the wiper would be able to maintain its cleaning effectiveness after it has started to absorb fluids.

Although the inventors should not be held to a particular theory of operation, it is believed that the lasting embossing pattern realized by the present invention is related to the nonwoven fibrous web 20. When the composite material 36 is heated, the polymer of the nonwoven fibrous web 20 is softened and nonwoven fibrous web 20 is molded in the embossing gap 54. When the composite material 36 is cooled, the nonwoven fibrous web 20 portion of the nonwoven composite material 36 sets up as a resilient structure, molded in the shape of the embossing pattern. The fibrous material 18 that is integrated into the nonwoven fibrous web 20 relies on the molded nonwoven fibrous web 20 as a sort of "backbone" to support the nonwoven composite material as a whole. In previously produced materials, a fibrous material 18 consisting of pulp would collapse along with the nonwoven fibrous web 20 when wet. With the process of the present invention such integrated pulp fibers may still compact to a degree with other pulp fibers when wet, but those pulp fibers will be resting on, and within, the resilient three-dimensional structure of the molded nonwoven fibrous web 20.

The well-defined pattern is resilient even when the material is compressed when it is wet. "Resiliency," as used in this context, refers to the ability of the material to recover, or "spring back", in response to release from compression forces. This wet resiliency can be quantified by the Wet Compression Rebound Ratio. The Wet Compression Rebound Ratio of the material is a measure of the wet resiliency of the material after compression forces have been applied. A programmable strength measurement device is used in compression mode to impart a specified series of compression cycles to a wet sample. While measurements are taken throughout the compression cycles, the information of interest is the ability of the material to spring back upon relief from the initial compression of the material.

Compression measurements are performed with a Constant Rate of Extension (CRE) tensile tester equipped with a computerized data-acquisition system. A SINTECH 500s tensile tester workstation, from MTS Systems Corporation, Eden Prairie, Minn., USA, was used with a computer running TestWorks 4.0 data acquisition software. A 100N load cell is used along with a pair circular platens for sample compression. The upper platen has a 2.25 inch (57.2 mm) diameter and the lower platen, on which the compression sample rests, has a 3.5 inch (88.9 mm) diameter. The upper and lower platens are initially set at a gap of 1.0 inch (25.4 mm). The load cell is allowed to warm up for a minimum of 30 minutes before any testing is conducted.

The samples are prepared and tested under TAPPI conditions, namely 23°±1° C. (73.4°±1.8° F.) and 50±2% relative humidity. A die is used to cut a 4 by 4-inch (101.6 by 101.6-mm) square sample. The dry sample is weighed and the weight is recorded as the "dry weight". The sample is then immersed in a bath of distilled water for 10 seconds. The wet sample is then placed on top of two pieces of blotter paper and two additional pieces of blotter paper are placed on top of the wet sample to remove any excess water. No additional weights are used. The blotter paper used is 100 lb. weight paper that measures 8.5 inches (215.9 mm) by 11 inches (279.4 mm). The wet sample is removed from the blotter papers after 10 seconds and is weighed and the weight is recorded as the "wet weight." The "Consistency" of the sample can be calculated by dividing the dry weight by the wet weight. The Consistency for the materials of the present invention is generally between 0.25 and 0.40. The wet sample is then placed on the lower platen of the testing device.

The testing equipment is programmed to perform three compression cycles. The crosshead initially descends at a speed of 2 inches per minute until the upper platen contacts the sample and the crosshead speed is reduced to 0.5 inches per minute for the remainder of the testing cycles. The software recognizes contact with the sample as the point where a compression force of 0.05 lbs-force is registered by the testing equipment. The testing equipment records the load force for corresponding sample bulks at an acquisition rate of 10 Hz. The crosshead continues to descend at 0.5 inches per minute and the wet sample is compressed between the upper and lower platens until a compression force of 20 lbs-force is reached. When this upper force limit is reached, the crosshead reverses direction to unload the wet sample. When the testing equipment registers a load of less than 0.05 lbs-force, the crosshead reverses its direction to start the second cycle of compression of the sample. The test continues with a second and third compression cycle in the same manner as the first compression cycle.

Figure 13:
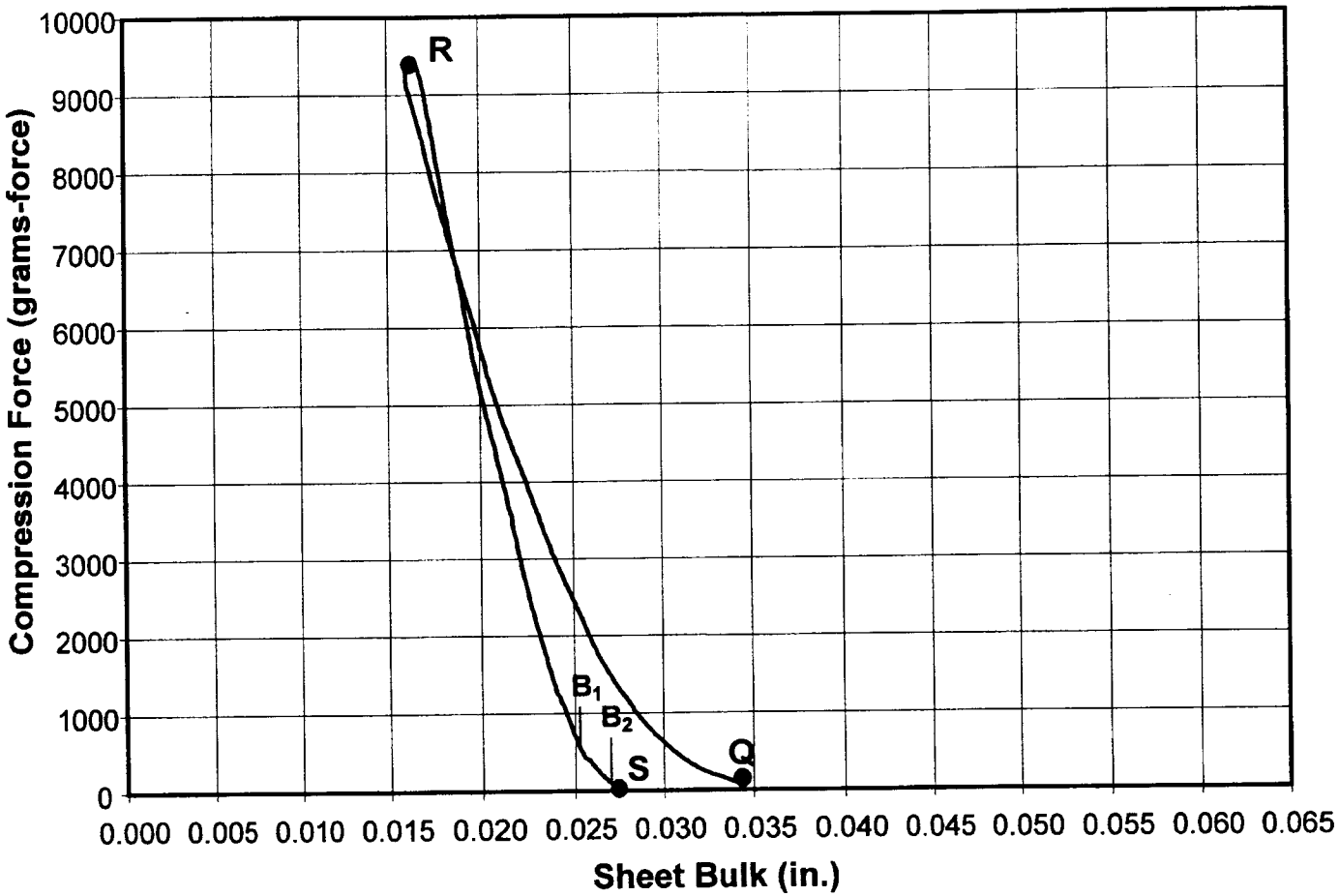
FIG. 13 is a graph of compression force versus sample bulk determined during wet compression rebound ratio testing.
Figure 14:
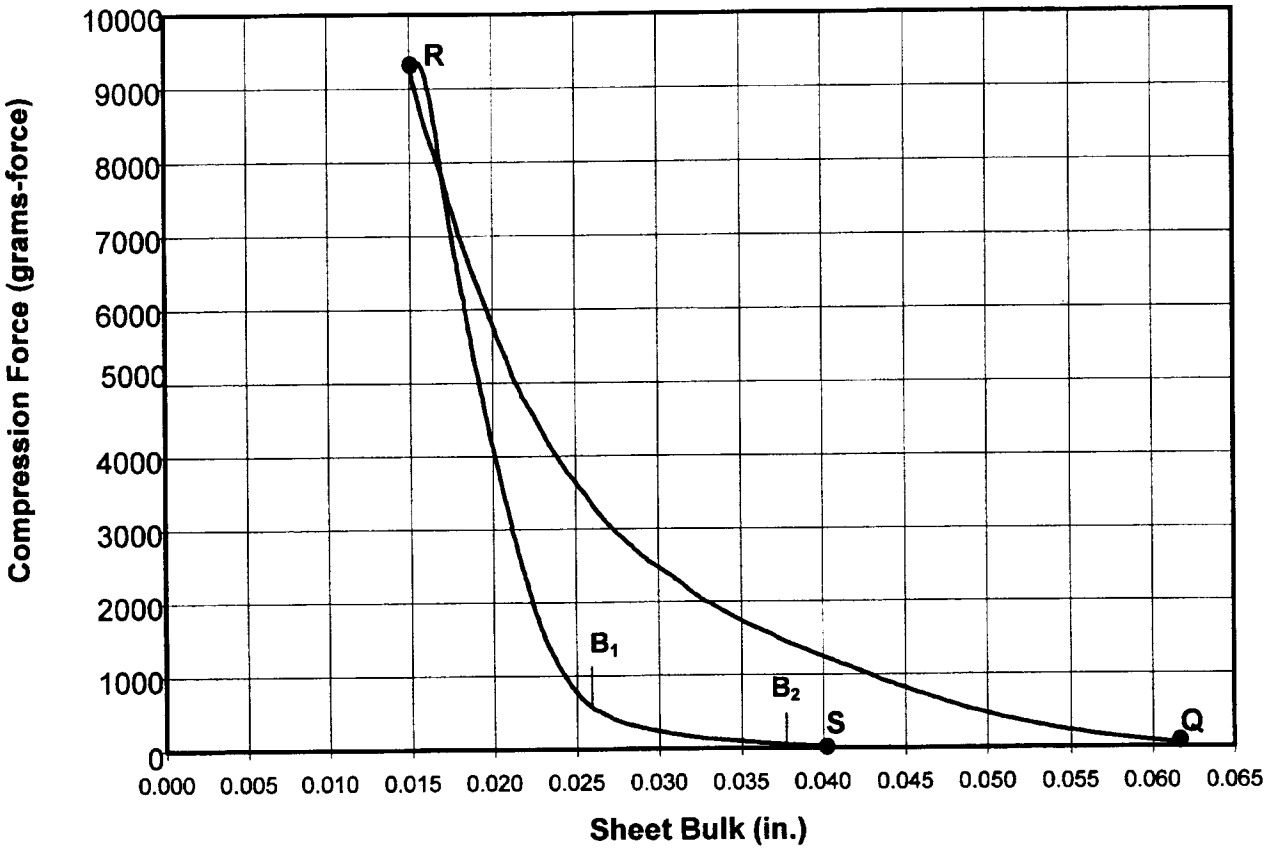
FIG. 14 is a graph of compression force versus sample bulk determined during wet compression rebound ratio testing.

The Wet Compression Rebound Ratio (WCRR) is calculated from load and sample bulk data recorded during the return portion of the first compression cycle. The WCRR can be represented by the relation:

$$WCRR = \frac{(B_2 - B_1)}{B_1}$$

where $B_1$=sample bulk at 500 grams-force on the first return cycle $B_2$=sample bulk at 50 grams-force on the first return cycle FIGS. 13 and 14 are exemplary compression force versus sample bulk curves generated for the WCRR test. Each of the curves shows the compression force versus sample bulk for the first compression cycle for a particular sample. Both figures show the initial compression portion of the first cycle as the portion of the curve between points Q and R. The return portion of the cycle of the first cycle is shown as the portion of the curve between points R and S. The sample bulk used to calculate WCRR are indicated on the return portion of the curves (between points R and S); the sample bulk at 500 grams-force is indicated on both figures as $B_1$ and the sample bulk at 50 grams-force is indicated on both figures as $B_2$.

FIG. 13 is an example of a data curve for a material with a relatively low WCRR value (WCRR=0.07). FIG. 14 is an example of a data curve for a material with a higher WCRR (WCRR=0.43) as produced by the present invention. Description of the materials shown in FIGS. 13 and 14 can be found in the discussion of Examples 6 and 11 below.

Higher WCRR values reflect a material that is able to better recover from compression when the material is wet. Such materials are able to maintain a visible pattern that can provide the desired cleaning properties even after the material has been saturated with fluid. It is desired that the WCRR be greater than about 0.08 as materials of the present invention with a WCRR greater than about 0.08 had the desired softness, drapeability and pattern resiliency. It is even more desired that the material has a WCRR greater than about 0.13. It is even more desired that the material has a WCRR greater than about 0.15. The present invention includes materials having a WCRR in the range of about 0.08 to 3.00. The present invention also includes materials having a WCRR in the range of about 0.08 to about 0.60. The present invention also includes materials having a WCRR in the range of about 0.08 to about 0.45.

Figure 15:
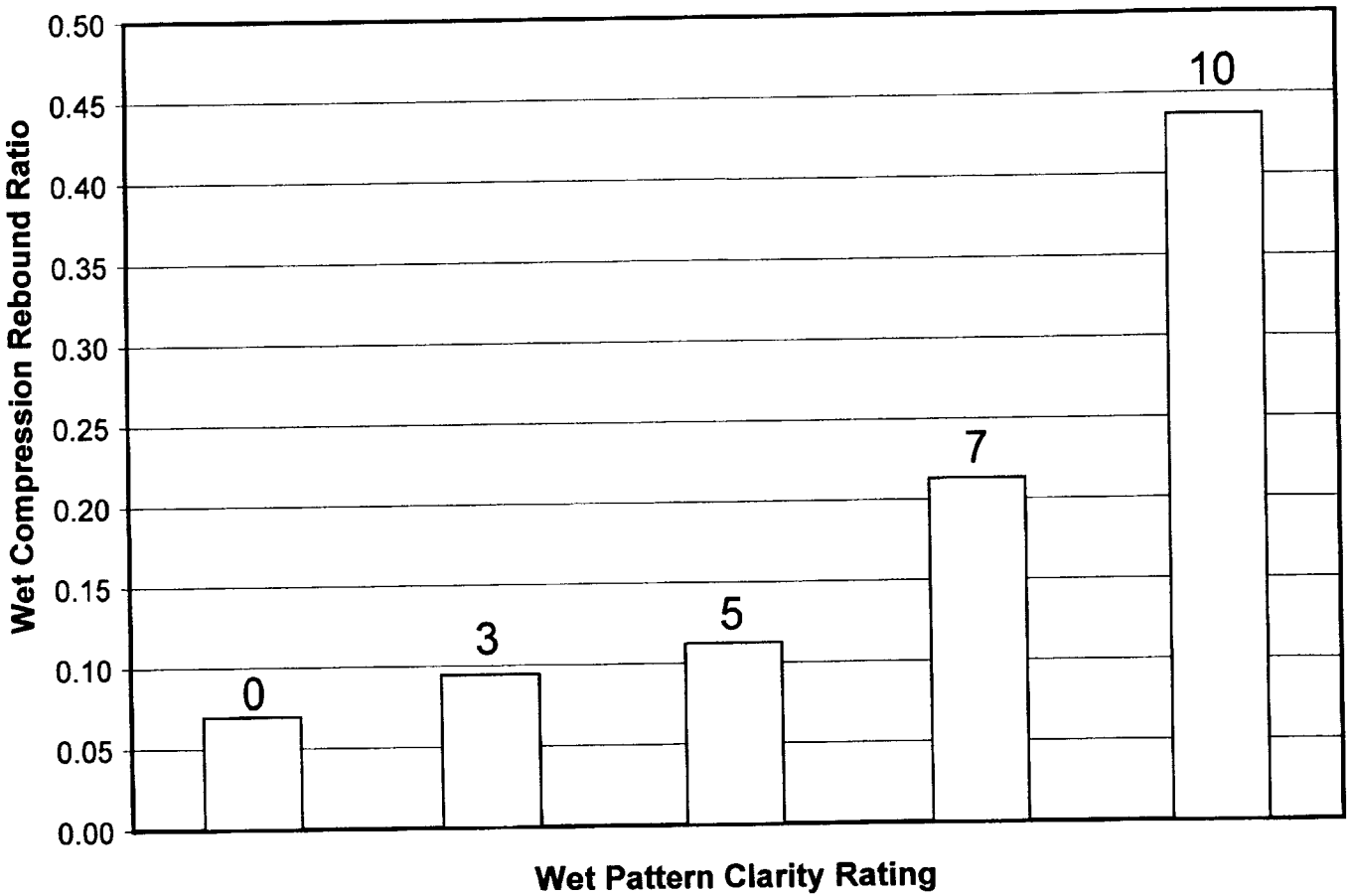
FIG. 15 is a bar graph comparing wet compression rebound ratios values with qualitative wet pattern clarity observations.

The inventors have also found that the quantitative values reported by the WCRR testing compliment the qualitative assessment of the pattern clarity rating. Samples of materials of the present invention that were qualitatively evaluated as having a wet pattern clarity values of "0", "3", "5", "7" and "10" were tested by the WCRR test method. The comparison of the wet pattern clarity rating and the WCRR values is shown in FIG. 15. As can be seen in FIG. 15, the WCRR values are greater for samples that had a higher qualitative pattern clarity rating. A WCRR greater than 0.10 appears have wet pattern clarity rating of "5" or higher. Such a pattern clarity rating would indicate a material that would have good pattern definition when wet. Such pattern clarity would be readily visible to the user and provide adequate texture, in a wiper, to effectively clean liquids and particulate matter even when the material has become wet.

It should be noted that data obtained from the second and third compression cycles provide directionally similar results to those that are obtained on the first cycle. However, as would be expected, the value of WCRR for a particular sample, if calculated for each cycle rather than just the first cycle, decreases with each successive compression cycle. However, the data from the second and third cycles, directionally give the same results; higher clarity ratings align with higher WCRR values. The greatest differentiation between samples of various qualitative clarity ratings is found with WCRR calculated from the data of the first compression cycle.

As discussed above, a wiper that is made of the three-dimensional hydraulically entangled nonwoven fibrous composite structure would have a texture that would effectively clean liquids and particulate matter when the material is either wet or dry. Such a wiper may be made of single layer of such a material and may have a basis weight from about 7 gsm to about 300 gsm. Additionally, wipers may be made of multiple layers of such a nonwoven fibrous composite structure and have a basis weight from about 20 gsm to about 600 gsm.

Figure 9:
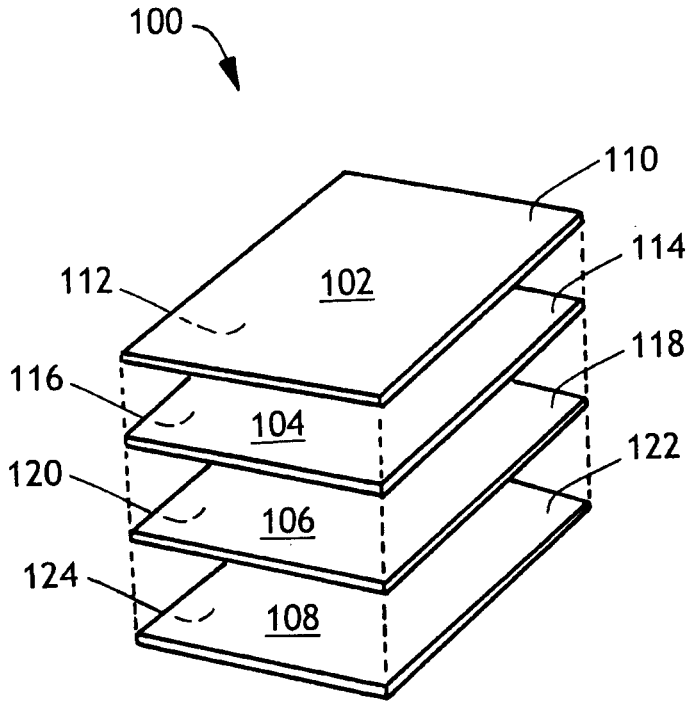
FIG. 9 is a representation of an exemplary absorbent structure that contains a hydraulically entangled nonwoven composite material.

In addition to the use of this inventive material as a wiper, it could also be used as a fluid distribution component of an absorbent personal care product. FIG. 9 is an exploded perspective view of an exemplary absorbent structure 100 which incorporates a high pulp content nonwoven composite fabric as a fluid distribution material. FIG. 9 merely shows the relationship between the layers of the exemplary absorbent structure and is not intended to limit in any way the various ways those layers may be configured in particular products. For example, an exemplary absorb structure may have fewer layers or more layers than shown in FIG. 9. The exemplary absorbent structure 100, shown here as a multi-layer composite suitable for use in a disposable diaper, feminine pad or other personal care product contains four layers, a top layer 102, a fluid distribution layer 104, an absorbent layer 106, and a bottom layer 108. The top layer 102 may be a nonwoven web of melt-spun fibers or filaments, an apertured film or an embossed netting. The top layer 102 functions as a liner for a disposable diaper, or a cover layer for a feminine care pad or personal care product. The upper surface 110 of the top layer 102 is the portion of the absorbent structure 100 intended to contact the skin of a wearer. The lower surface 112 of the top layer 102 is superposed on the fluid distribution layer 104 which is a high pulp content nonwoven composite fabric. The fluid distribution layer 104 serves to rapidly desorb fluid from the top layer 102, distribute fluid throughout the fluid distribution layer 104, and release fluid to the absorbent layer 106. The fluid distribution layer 104 has an upper surface 114 in contact with the lower surface 112 of the top layer 102. The fluid distribution layer 104 also has a lower surface 116 superposed on the upper surface 118 of an absorbent layer 106. The fluid distribution layer 104 may have a different size or shape than the absorbent layer 106. The absorbent layer 106 may be layer of pulp fluff, superabsorbent material, or mixtures of the same. The absorbent layer 106 is superposed over a fluid-impervious bottom layer 108. The absorbent layer 106 has a lower surface 120 which is in contact with an upper surface 122 of the fluid impervious layer 108. The bottom surface 124 of the fluid-impervious bottom layer 108 provides the outer surface for the absorbent structure 100. In more conventional terms, the liner layer 102 is a topsheet, the fluid-impervious bottom layer 108 is a backsheet, the fluid distribution layer 104 is a distribution layer, and the absorbent layer 106 is an absorbent core. Each layer may be separately formed and joined to the other layers in any conventional manner. The layers may be cut or shaped before or after assembly to provide a particular absorbent personal care product configuration.

When the layers are assembled to form a product such as, for example, a feminine pad, the fluid distribution layer 104 of the high pulp content nonwoven composite fabric provides the advantages of reducing fluid retention in the top layer, improving fluid transport away from the skin to the absorbent layer 106, increased separation between the moisture in the absorbent layer 106 and the skin of a wearer, and more efficient use of the absorbent layer 106 by distributing fluid to a greater portion of the absorbent. These advantages are provided by the improved vertical wicking and water absorption properties. In one aspect of the invention, the fluid distribution layer 104 may also serve as the top layer 102 and/or the absorbent layer 106. A particularly useful nonwoven composite fabric for such a configuration is one formed with a pulp-rich side and a predominantly continuous filament substrate side.

Additionally, the top layer 102 of the absorbent product illustrated in FIG. 9 may made of the inventive nonwoven composite material. Such a top layer 102 would likely have a basis weight less than 100 gsm. The basis weight of such a top layer 102 would more preferably be between 7 gsm and 50 gsm.

The structure of the invention can be described as a resilient three-dimensional hydraulically entangled fibrous structure. This structure is made of at least one moldable coherent nonwoven fibrous web and fibrous material(s) integrated into the nonwoven fibrous web by hydraulic entangling. The three-dimensional structure has at least a first planar surface and a plurality of embossments that extend from the first planar surface and where at least a portion of the three-dimensional structure provides a wet compression rebound ratio greater than about 0.08.

A series of examples were developed to demonstrate and distinguish the attributes of the present invention. Such Examples are not presented to be limiting, but in order to demonstrate various attributes of the inventive material.

EXAMPLES

Example 1

A high pulp content hydraulically entangled nonwoven composite fabric was made by the process of U.S. Pat. No. 5,284,703 to Everhart et al. The material was made by laying a pulp layer on a 0.75 osy web of polypropylene spunbond fibers. The spunbond material was bonded with a pattern commonly known in the art as a "wire weave" pattern, such as shown in FIG. 3, having a bond area in the range of from about 15% to about 21% and about 308 bonds per square inch. The pulp layer was a blend of about 50 percent, by weight, Northern softwood kraft pulp fibers and about 50 percent, by weight, Southern softwood kraft pulp fibers. The material was Yankee creped. The basis weight of the resulting hydraulically entangled composite fabric was 116 gsm.

The resulting material was evaluated as to wet pattern clarity and was observed to have a qualitative wet clarity rating of zero.

Example 2

The material of Example 1 was run through an embossing gap on a pilot line embossing process. The embossing process was a pair of matched embossing rolls both made of steel and having a nominal diameter of 8 inches. The embossing rolls were heated internally by circulating oil, heated to 195° F. The embossing pattern of the embossing rolls was as shown in FIG. 7, with a pin height of 0.072 inches and a pocket depth of 0.072 inches. The material of Example 1 was heated by running the material through an infrared heating unit located before and proximate to the embossing rolls. The heating unit used recirculating air and two mid-band infrared platens, placed approximately 3 inches from the web, to heat the material prior to its entry into the embossing gap.

The material entering the embossing gap was heated to a surface temperature of 117° F. as measured by an infrared radiometer gun aimed at the material surface just before entering the embossing gap. The gap of the matched embossing rolls was set at 0.040 inches. The material was sent through the embossing gap at a speed of 300 feet per minute (fpm).

The resulting material was evaluated as to wet pattern clarity and was observed to have a qualitative wet clarity rating of one.

Example 3

The material of Example 1 was run through the same pilot process as described in Example 2. The embossing pattern of the embossing rolls was as shown in FIG. 7, with a pin height of 0.072 inches and a pocket depth of 0.072 inches The material entering the embossing gap was heated to a surface temperature of 183° F. as measured by an infrared radiometer gun aimed at the material surface just before entering the embossing gap. The gap of the matched embossing rolls was set at 0.030 inches. The material was sent through the embossing gap at a speed of 135 fpm.

The resulting material was evaluated as to wet pattern clarity and was observed to have a qualitative wet clarity rating of three.

Example 4

The material of Example 1 was run through the same pilot process as described in Example 2. The embossing pattern of the embossing rolls was as shown in FIG. 7, with a pin height of 0.072 inches and a pocket depth of 0.072 inches. The material entering the embossing gap was heated to a surface temperature of 182° F. as measured by an infrared radiometer gun aimed at the material surface just before entering the embossing gap. The gap of the matched embossing rolls was set at 0.025 inches. The material was sent through the embossing gap at a speed of 110 fpm.

The resulting material was evaluated as to wet pattern clarity and was observed to have a qualitative wet clarity rating of eight.

Examples 1-4 show an improvement of wet pattern clarity with increased embossing roll engagement, increased temperature and slower line speeds. As expected increasing the amount of heat used and time to heat the material improved the quality of the embossing when coupled with a greater embossing roll engagement.

Example 5

A material similar to that of Example 1 was run through the same embossing process as described in Example 2. The embossing pattern of the embossing rolls was as shown in FIG. 7, with a pin height of 0.072 inches and a pocket depth of 0.072 inches. The material entering the embossing gap was heated to a surface temperature of 175° F. as measured by an infrared radiometer gun aimed at the material surface just before entering the embossing gap. The gap of the matched embossing rolls was set at 0.035 inches. The material was sent through the embossing gap at a speed of 450 fpm.

The resulting material was evaluated as to wet pattern clarity and was observed to have a qualitative wet clarity rating of three. Additionally, WCRR testing was conducted on the material and it was found to have a WCRR of 0.073.

Example 6

A material made similarly to that of Example 1, except that the material was not creped. The basis weight of the material was 115 gsm. The resulting material was evaluated as to wet pattern clarity and was observed to have a qualitative wet clarity rating of zero. Additionally, WCRR testing was conducted on the material and it was found to have a WCRR of 0.070. FIG. 13, shows the plot of WCRR testing for the material of Example 6.

Example 7

A material made similarly to that of Example 6 was except that the material was Yankee creped. The basis weight of the material was 116 gsm. The resulting material was evaluated as to wet pattern clarity and was observed to have a qualitative wet clarity rating of zero.

Example 8

The material of Example 7 was run through the same embossing process as described in Example 2. The embossing pattern of the embossing rolls was as shown in FIG. 7, with a pin height of 0.072 inches and a pocket depth of 0.072 inches. The material entering the embossing gap was heated to a surface temperature of 166° F. as measured by an infrared radiometer gun aimed at the material surface just before entering the embossing gap. The gap of the matched embossing rolls was set at 0.021 inches. The material was sent through the embossing gap at a speed of 200 fpm.

The resulting material was evaluated as to wet pattern clarity and was observed to have a qualitative wet clarity rating of seven. Additionally, WCRR testing was conducted on the material and it was found to have a WCRR of 0.213.

Example 9

The material to Example 6 was run through the same embossing process similar to that described in Example 2. The embossing pattern of the embossing rolls was as shown in FIG. 7, with a pin height of 0.060 inches and a pocket depth of 0.072 inches.

The material entering the embossing gap was heated to a surface temperature of 148° F. as measured by an infrared radiometer gun aimed at the material surface just before entering the embossing gap. The gap of the matched embossing rolls was set at 0.034 inches. The material was sent through the embossing gap at a speed of 320 fpm.

The resulting material was evaluated as to wet pattern clarity and was observed to have a qualitative wet clarity rating of three. Additionally, WCRR testing was conducted on the material and it was found to have a WCRR of 0.094.

Example 10

The material to Example 6 was run through the same embossing process as described in Example 9. The embossing pattern of the embossing rolls was as shown in FIG. 7, with a pin height of 0.060 inches and a pocket depth of 0.072 inches. The material entering the embossing gap was heated to a surface temperature of 177° F. as measured by an infrared radiometer gun aimed at the material surface just before entering the embossing gap. The gap of the matched embossing rolls was set at 0.034 inches. The material was sent through the embossing gap at a speed of 140 fpm.

The resulting material was evaluated as to wet pattern clarity and was observed to have a qualitative wet clarity rating of five. Additionally, WCRR testing was conducted on the material and it was found to have a WCRR of 0.112.

Example 11

The material to Example 6 was run through the same embossing process as described in Example 9. The embossing pattern of the embossing rolls was as shown in FIG. 7, with a pin height of 0.060 inches and a pocket depth of 0.072 inches. The material entering the embossing gap was heated to a surface temperature of 185° F. as measured by an infrared radiometer gun aimed at the material surface just before entering the embossing gap. The gap of the matched embossing rolls was set at 0.028 inches. The material was sent through the embossing gap at a speed of 110 fpm.

The resulting material was evaluated as to wet pattern clarity and was observed to have a qualitative wet clarity rating of ten. Additionally, WCRR testing was conducted on the material and it was found to have a WCRR of 0.427.

FIG. 14, shows the plot of WCRR testing for the material of Example 11. Additionally, FIG. 15 charts the WCRR values for the qualitative wet pattern clarity ratings for the materials described in Examples 6, 8, 9, 10 and 11.

Comparative Examples 12-19

Comparative Examples 12 through 19 were tested for WCRR, the results of which are given in Table 1.

Examples 12 through 15 are all commercially available wipers from Kimberly-Clark Corporation, Roswell, Ga. Example 12 was two-plies of the one-ply WYPALL® L10 Utility Wiper. Example 13 was the four-ply WYPALL® L20 KIMTOWELS® Wiper. Example 14 was the two-ply WYPALL® L20 KIMTOWELS® Wiper. Example 15 was the one-ply WYPALL® L40 Wiper.

Examples 16 through 19 are all commercially available wipers from Georgia-Pacific, Atlanta, Ga. Example 16 was the TuffMate®—White, HYDRASPUN® Wiper (Item #25020). Example 17 was the TaskMate®—White, Airlaid Bonded Cellulose Wiper (Item #29112). Example 18 was the Shur-Wipe®—Russet, Airlaid Paper Wiper (Item #29220). Example 19 was the TaskMate®—White, Double Recreped Wiper (Item #20020).

TABLE 1

| Example | WCRR |
|---|---|
| 12 | 0.134 |
| 13 | 0.066 |
| 14 | 0.087 |
| 15 | 0.064 |
| 16 | 0.126 |
| 17 | 0.125 |
| 18 | 0.123 |
| 19 | 0.065 |

Example 20

A lighter weight, high pulp content hydraulically entangled nonwoven composite fabric was made by the process of U.S. Pat. No. 5,284,703 to Everhart et al. The material was made by laying a pulp layer on a 0.35 osy web of polypropylene spunbond fibers. The spunbond material was bonded with a pattern commonly known in the art as a "wire weave", such as shown in FIG. 3, having a bond area in the range of from about 15% to about 21% and about 308 bonds per square inch. The pulp layer was a blend of about 50 percent, by weight, Northern softwood kraft pulp fibers and about 50 percent, by weight, Southern softwood kraft pulp fibers. The material was Yankee creped. The basis weight of the resulting hydraulically entangled composite fabric was 45 gsm.

The material of was run through an embossing gap on the embossing process described in Example 2. The embossing pattern of the embossing rolls was as shown in FIG. 7, with a pin height of 0.060 inches and a pocket depth of 0.072 inches. The material entering the embossing gap was heated to a surface temperature of 189° F. as measured by an infrared radiometer gun aimed at the material surface just before entering the embossing gap. The gap of the matched embossing rolls was set at 0.012 inches. The material was sent through the embossing gap at a speed of 200 feet per minute (fpm).

The resulting material was evaluated as to wet pattern clarity and was observed to have a qualitative wet clarity rating of six. Additionally, WCRR testing was conducted on the material and it was found to have a WCRR of 0.132.

Example 21

A lighter weight, high pulp content hydraulically entangled nonwoven composite fabric was made similar to the material of Example 20, but the basis weight of the resulting hydraulically entangled composite fabric was 54 gsm.

The material of was run through an embossing gap on the embossing process described in Example 2. The embossing pattern of the embossing rolls was as shown in FIG. 7, with a pin height of 0.060 inches and a pocket depth of 0.072 inches. The material entering the embossing gap was heated to a surface temperature of 165° F. as measured by an infrared radiometer gun aimed at the material surface just before entering the embossing gap. The gap of the matched embossing rolls was set at 0.012 inches. The material was sent through the embossing gap at a speed of 200 feet per minute (fpm).

The resulting material was evaluated as to wet pattern clarity and was observed to have a qualitative wet clarity rating of five. Additionally, WCRR testing was conducted on the material and it was found to have a WCRR of 0.120.

Example 22

The unembossed, base material of Example 21 was run through the embossing process under a different set of embossing conditions. The embossing pattern of the embossing rolls was as shown in FIG. 7, with a pin height of 0.072 inches and a pocket depth of 0.072 inches. The material entering the embossing gap was heated to a surface temperature of 167° F. as measured by an infrared radiometer gun aimed at the material surface just before entering the embossing gap. The gap of the matched embossing rolls was set at 0.024 inches. The material was sent through the embossing gap at a speed of 200 feet per minute (fpm).

The resulting material was evaluated as to wet pattern clarity and was observed to have a qualitative wet clarity rating of six. Additionally, WCRR testing was conducted on the material and it was found to have a WCRR of 0.133.

Example 23

A lighter weight, high pulp content hydraulically entangled nonwoven composite fabric was made similar to the material of Example 20, but the basis weight of the resulting hydraulically entangled composite fabric was 64 gsm.

The material of was run through an embossing gap on the embossing process described in Example 2. The embossing pattern of the embossing rolls was as shown in FIG. 7, with a pin height of 0.060 inches and a pocket depth of 0.072 inches. The material entering the embossing gap was heated to a surface temperature of 152° F. as measured by an infrared radiometer gun aimed at the material surface just before entering the embossing gap. The gap of the matched embossing rolls was set at 0.012 inches. The material was sent through the embossing gap at a speed of 150 feet per minute (fpm).

The resulting material was evaluated as to wet pattern clarity and was observed to have a qualitative wet clarity rating of six. Additionally, WCRR testing was conducted on the material and it was found to have a WCRR of 0.127.

Example 24

The unembossed, base material of Example 23 was run through the embossing process under a different set of embossing conditions. The embossing pattern of the embossing rolls was as shown in FIG. 7, with a pin height of 0.072 inches and a pocket depth of 0.072 inches. The material entering the embossing gap was heated to a surface temperature of 150° F. as measured by an infrared radiometer gun aimed at the material surface just before entering the embossing gap. The gap of the matched embossing rolls was set at 0.022 inches. The material was sent through the embossing gap at a speed of 150 feet per minute (fpm).

The resulting material was evaluated as to wet pattern clarity and was observed to have a qualitative wet clarity rating of seven. Additionally, WCRR testing was conducted on the material and it was found to have a WCRR of 0.151.

We claim:

1. A method of making an embossed, hydraulically entangled nonwoven composite fabric having a nonwoven component and a fibrous component consisting of fibers, said method comprising:

superposing a fibrous material layer over a nonwoven fibrous web layer;

hydraulically entangling said layers to form a composite material;

drying the composite material;

heating the composite material to form a heated composite material; and embossing the heated composite material in an embossing gap formed by a pair of matched embossing rolls; and wherein heating the composite material occurs after the drying of the composite and the heating is by an additional heat source.

2. The method of claim 1 where prior to embossing the composite material in the embossing gap, the surface of the composite material is heated to a temperature greater than about 140° F.

3. The method of claim 1 where prior to embossing the composite material in the embossing gap, the surface of the composite material is heated to a temperature greater than about 200° F.

4. The method of claim 1 where prior to embossing the composite material in the embossing gap, the surface of the composite material is heated to a temperature greater than about 300° F.

5. The method of claim 1 where the matched embossing rolls are heated.

6. The method of claim 1 wherein the layers are superposed by depositing a fibrous material layer, comprising a suspension of fibers, onto a nonwoven fibrous web layer of continuous filaments, by drying forming or wet-forming.

7. The method of claim 1 wherein the fibrous material layer is superposed over a nonwoven fibrous web layer of continuous spun bonded filaments.

8. The method of claim 1 further comprising the step of adding a material selected from clays, activated charcoals, starches, particulates, and superabsorbent particulates to the superposed layers prior to hydraulic entangling.

9. The method of claim 1 further comprising the step of adding a material selected from clays, activated charcoals, starches, particulates, and superabsorbent particulates to the superposed, hydraulically entangled composite material.

10. The method of claim 6 further comprising the step of adding a material selected from clays, activated charcoals, starches, particulates, and superabsorbent particulates to the suspension of fibers used to form the fibrous material layer on the nonwoven fibrous web layer of continuous filaments.

11. The method of claim 1 wherein the hydraulically entangled nonwoven composite fabric is subjected to a finishing step selected from mechanical softening, pressing, creping, and brushing.

12. The method of claim 1 wherein the hydraulically entangled nonwoven composite fabric is subjected to a chemical post-treatment selected from dyes and adhesives.

13. An embossed, hydraulically entangled nonwoven composite fabric made by the method of claim 1 having a wet compression rebound ratio greater than about 0.13.

14. The embossed, hydraulically entangled nonwoven composite fabric of claim 13 having a wet compression rebound ratio is greater than about 0.15.

15. The embossed, hydraulically entangled nonwoven composite fabric of claim 13 where the wet compression rebound ratio is between about 0.13 and about 3.00.

16. The embossed, hydraulically entangled nonwoven composite fabric of claim 13 where the wet compression rebound ratio is between about 0.13 and about 0.60.

17. The embossed, hydraulically entangled nonwoven composite fabric of claim 13 where the wet compression rebound ratio is between about 0.13 and about 0.45.

18. The embossed, hydraulically entangled nonwoven composite fabric of claim 13 where the wet compression rebound ratio is between about 0.15 and about 0.45.

19. The method of claim 1, wherein the matched embossing rolls comprise a male embossing roller having a plurality of pins extending from the roller periphery and a matching female embossing roller having a plurality of pockets which extend into the roller from the roller periphery, wherein the pins of the male roller extend into the pockets of the female roller in the embossing gap.

* * * * *